US007571989B2

(12) United States Patent
Ishizaki

(10) Patent No.: US 7,571,989 B2
(45) Date of Patent: Aug. 11, 2009

(54) DROPLET EJECTION HEAD DRIVING CIRCUIT AND METHOD, AND DROPLET EJECTION DEVICE

(75) Inventor: Sunao Ishizaki, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 552 days.

(21) Appl. No.: 11/498,437

(22) Filed: Aug. 3, 2006

(65) Prior Publication Data

US 2007/0165074 A1 Jul. 19, 2007

(30) Foreign Application Priority Data

Jan. 17, 2006 (JP) ..... 2006-008648

(51) Int. Cl.
*B41J 2/05* (2006.01)

(52) U.S. Cl. ..... 347/57; 347/68

(58) Field of Classification Search ..... 347/9, 347/10, 20, 56–59, 61–65, 67–68, 70–71
See application file for complete search history.

(56) References Cited

U.S. PATENT DOCUMENTS 6,334,668 B1 * 1/2002 Isamoto ..... 347/57

* cited by examiner

*Primary Examiner*—Juanita D Stephens
(74) *Attorney, Agent, or Firm*—Fildes & Outland, P.C.

(57) ABSTRACT

A driving circuit of a droplet ejection head which, by supplying analog driving signals to driving elements, ejects droplets from nozzles which are provided in correspondence with the driving elements. The driving circuit includes a driving signal generation unit, a pulse modulation unit, a switching signal generation unit, an amplification unit and a frequency-setting unit. The driving signal generation unit selectively outputs a first and a second analog driving signal. The pulse modulation unit pulse-modulates the analog driving signal and outputs a digital signal. The switching signal generation unit generates a switching signal. The amplification unit amplifies the digital signal by switching in accordance with the switching signal, and supplies the amplified digital signal to the driving elements. The frequency-setting unit sets a switching frequency of the switching signal in accordance with a frequency selection signal, which corresponds to the analog driving signal.

21 Claims, 13 Drawing Sheets

FIG. 7A $V_1$

FIG. 7B $V_2$

FIG. 7C $V_3$

FIG. 7D $V_4$

DROPLET EJECTION HEAD DRIVING CIRCUIT AND METHOD, AND DROPLET EJECTION DEVICE

BACKGROUND

1. Technical Field

The present invention relates to a droplet ejection head driving circuit and method and a droplet ejection device, and more specifically relates to a droplet ejection head driving circuit and method for supplying driving signals to a droplet ejection head in order to agitate ink, even in a non-printing mode, and to a droplet ejection device therewith.

2. Related Art

High-speed recording is possible with an inkjet recording apparatus which employs a long head in which short head units (short heads) are joined together (for example, a full width array (FWA) head, which is to say, a head which is lengthened to the width of paper). Accordingly, in recent years, the development of inkjet recording apparatuses which employ these long heads has proceeded apace.

In an inkjet recording apparatus which employs this long head, a water content of ink may be reduced in order to prevent swelling of paper, and a processing fluid may be employed in order to hasten drying. Consequently, solidification of ink in ink channels within the recording head and at a nozzle face has become a problem. In order to prevent this, it is necessary to cause vibrations at the ink channels and nozzle face to agitate the ink when in a non-printing mode.

As shown in FIG. 13, energy that an inkjet recording apparatus consumes differs between a preliminary state (warm-up), an operating state (running), a waiting state (stand-by), and a paused state (sleep). An energy consumption efficiency η of the inkjet recording apparatus is shown by the following equation.

$$\eta = \frac{1}{T_{total}} \sum_{n} T_n W_n \tag{1}$$

Therein, $T_n$ represents a duration of each state, $W_n$ represents a power consumption of each state, and the subscripts n are values from 1 to 4.

In order to improve the energy consumption efficiency η, as well as lowering power consumption in the running state, which is a printing mode, lowering power consumption in other states which are a non-printing mode, that is, the warm-up state, the standby state and the sleep state, is required. However, in the standby state, because prompt printing is required when printing data has been inputted, it is difficult to lower the power consumption.

SUMMARY

The present invention will provide a droplet ejection head driving circuit and method which are capable of reducing power consumption in a non-printing mode, while preventing solidification of ink and the like, and a droplet ejection device.

A first aspect of the present invention is a driving circuit of a droplet ejection head that, by supplying an analog driving signal to a driving element, ejects a droplet from a nozzle provided in correspondence with the driving element, the droplet ejection head driving circuit including: a driving signal generation unit that generates at least a first analog driving signal, for ejecting a droplet from the nozzle, and at least a second analog driving signal, for vibrating a liquid surface of ink in the droplet ejection head, and selectively outputs either of the analog driving signals; a pulse modulation unit that pulse-modulates the analog driving signal output from the driving signal generation unit and outputs a digital signal; a switching signal generation unit, which generates a switching signal; an amplification unit that amplifies the digital signal by switching in accordance with the switching signal, and supplies the amplified digital signal to the driving element; and a frequency-setting unit that sets a switching frequency of the switching signal in accordance with a frequency selection signal, the frequency selection signal corresponding to the analog driving signal that is being output from the driving signal generation unit.

BRIEF DESCRIPTION OF THE DRAWINGS

Exemplary embodiments of the present invention will be described in detail based on the following figures, in which:

FIG. 13 is a diagram for explaining power consumption in states such as a warm-up state and the like.

DETAILED DESCRIPTION

Herebelow, exemplary embodiments of the present invention will be described in detail with reference to the drawings. For each embodiment, a droplet ejection device which ejects liquid droplets will be described as an example.

First Exemplary Embodiment

Figure 1:
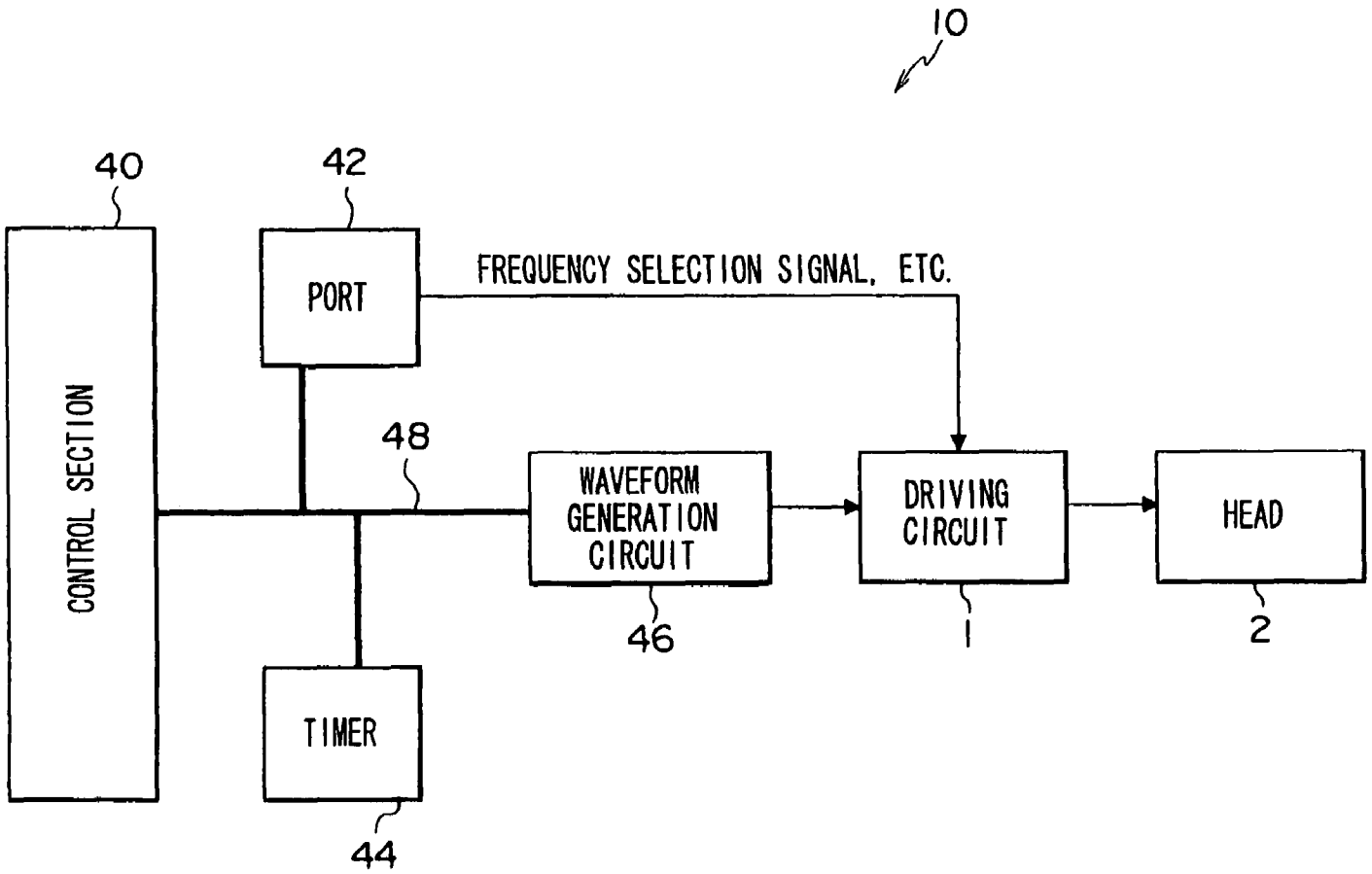
FIG. 1 is a diagram showing circuit structure of a droplet ejection device relating to a first embodiment.

FIG. 1 shows a schematic block diagram of a control system of a droplet ejection device 10. As shown in FIG. 1, the droplet ejection device 10 is structured with a driving circuit 1, a head 2, a control section 40, a port 42, a timer 44 and a waveform generation circuit 46. The control section 40, port 42, timer 44 and waveform generation circuit 46 are connected via a bus 48.

The droplet ejection device 10 operates in respective modes of a preliminary state (warm-up), an operation state (running), a waiting state (stand-by), and a paused state (sleep). The warm-up state is a state in which, for example, initialization processing and the like for an unillustrated memory, logic circuit and the like of the droplet ejection device 10 is executed. The running state is a state during execution of printing in accordance with inputted printing data. The standby state is a state from which is possible to commence printing promptly when printing data is received. The sleep state is a state in which prompt commencement of printing if printing data is received is not possible, with restart processing such as suctioning up of ink and the like being required. The control section 40 switches between the above-described states in accordance with operational conditions of the device. The timer 44 is used when control is to be performed such as, for example, switching to the sleep state after the standby state has continued for a predetermined duration or the like.

Figure 2:
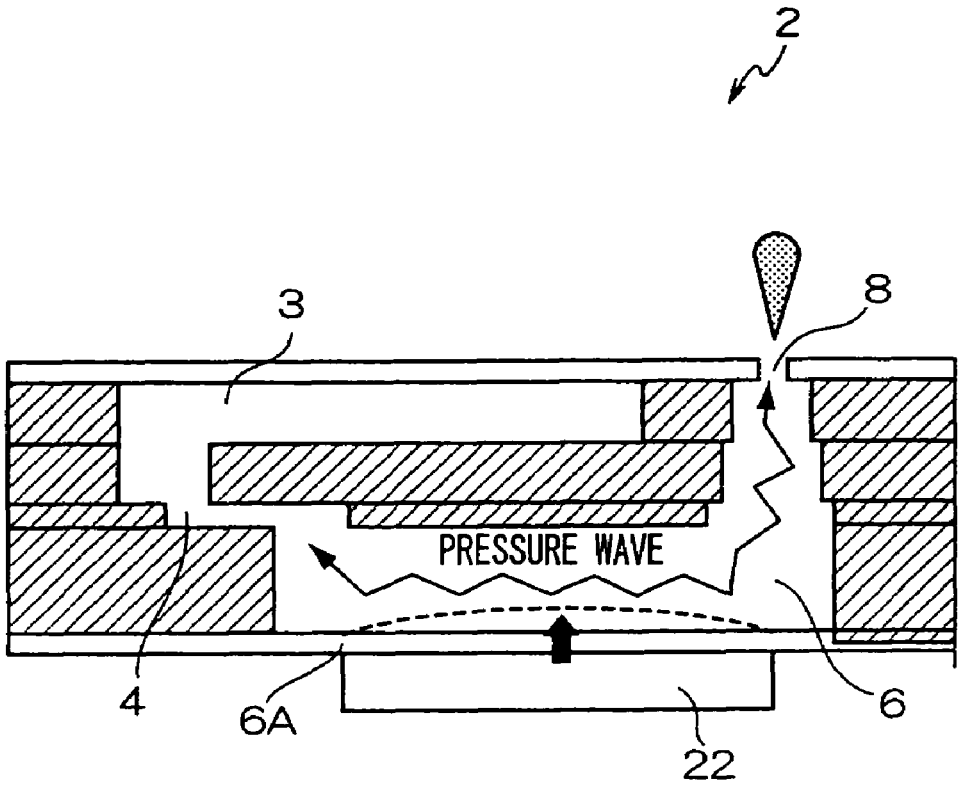
FIG. 2 is a sectional view showing internal structure of a droplet ejection head.

FIG. 2 shows internal structure of the head 2. The head 2 has a long form in which a large number of nozzles are provided. Portions corresponding to individual nozzles have mutually matching structures, and only a portion corresponding to a single nozzle is shown in FIG. 2.

As shown in FIG. 2, the head 2 is provided with an ink tank 3, and ink which has been supplied through an unillustrated ink supply channel is accumulated in this ink tank 3. The ink tank 3 communicates with a pressure chamber 6 via a supply channel 4, and the pressure chamber 6 is charged with ink supplied through the supply channel 4 from the ink tank 3. A portion of a wall face of the pressure chamber 6 is structured by a diaphragm 6A. A piezoelectric actuator 22 is joined to the diaphragm 6A by adhesion or the like. When a voltage is applied to the piezoelectric actuator 22, the piezoelectric actuator 22 displaces and the diaphragm 6A oscillates, and the oscillation of the diaphragm 6A is propagated in the pressure chamber 6 as a pressure wave. Hence, ink in the pressure chamber 6 is ejected as ink droplets through a nozzle 8, which communicates with the pressure chamber 6.

Figure 3:
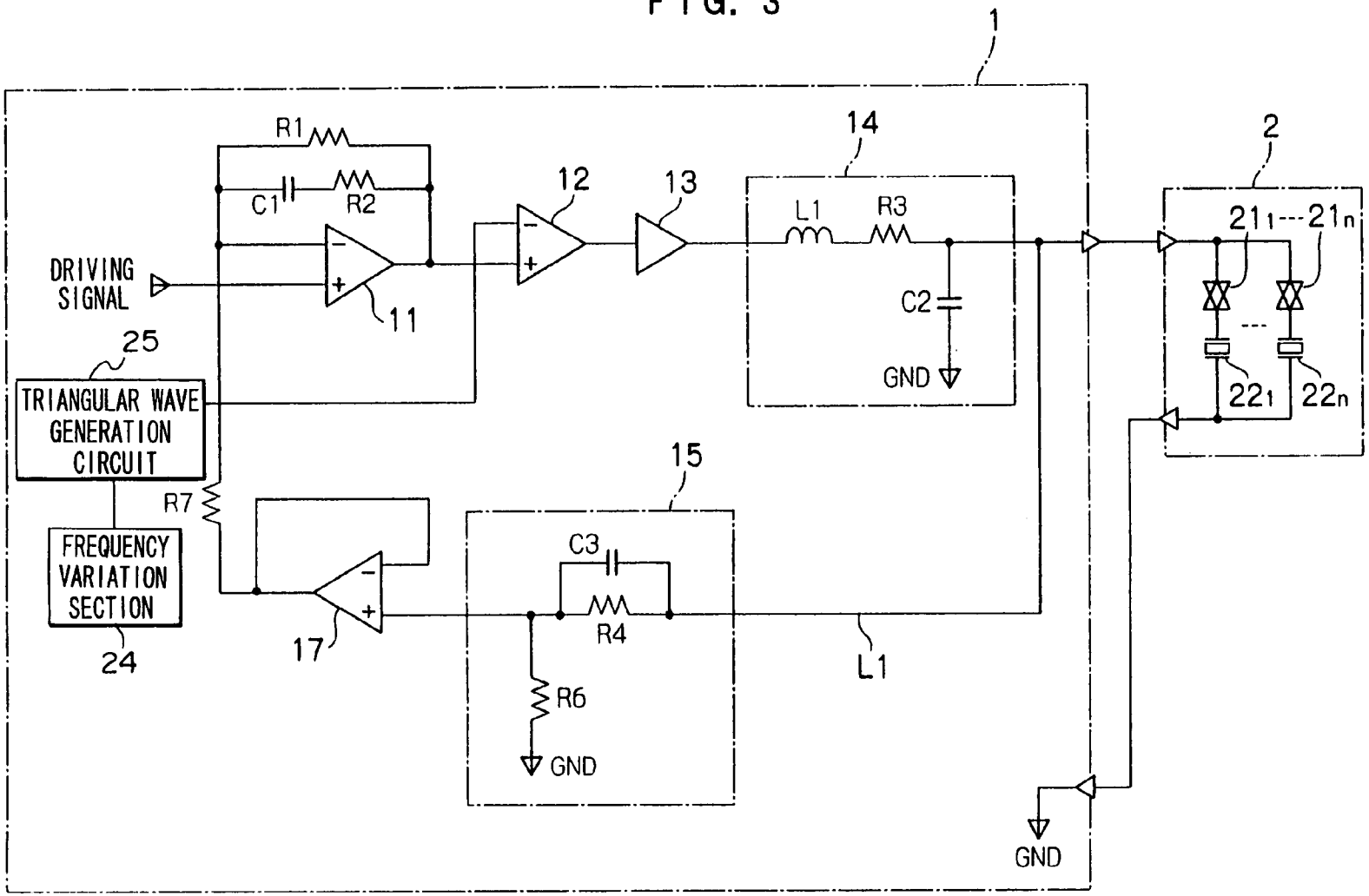
FIG. 3 is a circuit diagram of a driving circuit.

FIG. 3 shows circuit structure of the driving circuit 1. The driving circuit 1 is provided with an operational amplifier 11, a comparator 12, a digital voltage amplifier 13 and a filter 14.

The head 2 is provided with n transmission gates $\mathbf{21}_1$ to $\mathbf{21}_n$ (n being a natural number), and n piezoelectric actuators $\mathbf{22}_1$ to $\mathbf{22}_n$, which are connected in series with the transmission gates $\mathbf{21}_1$ to $\mathbf{21}_n$, respectively.

Figure 4A:
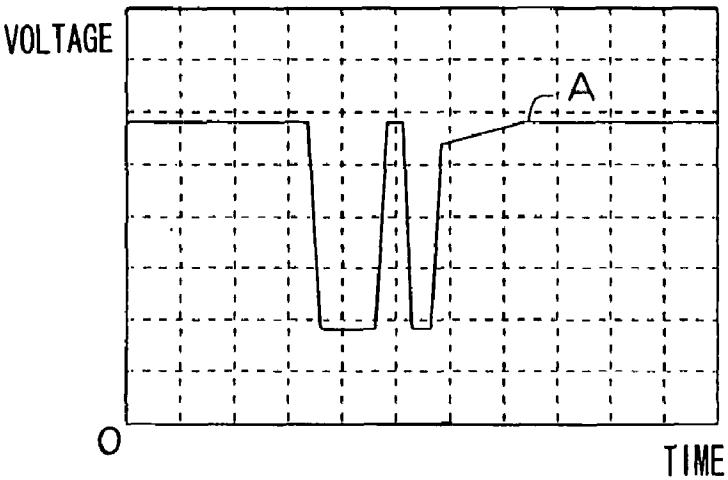
FIG. 4A is a waveform diagram of a driving signal which is supplied to a piezoelectric actuator in a printing mode.
Figure 4B:
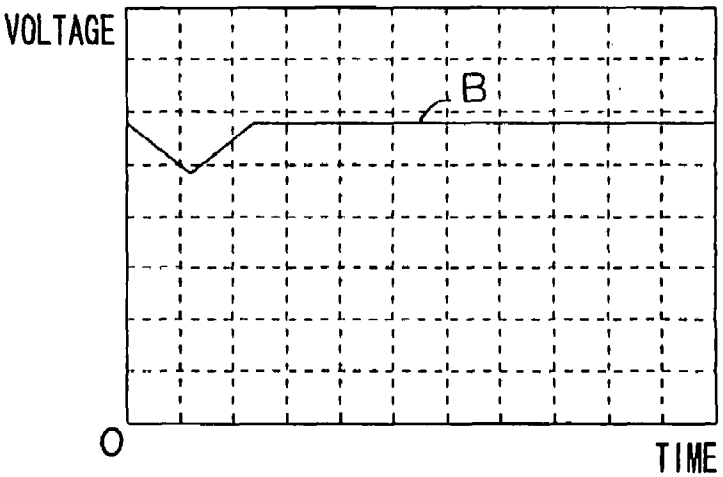
FIG. 4B is a waveform diagram of a driving signal which is supplied to a piezoelectric actuator in a non-printing mode.

An analog driving signal from the waveform generation circuit 46 is inputted to the non-inverting input terminal of the operational amplifier 11. In the running state, that is, the printing mode, the waveform generation circuit 46 generates a waveform similar to driving signal A as shown in FIG. 4A, such that driving signal A is applied to the piezoelectric actuator(s) 22. Driving signal A is a waveform which is capable of ejecting ink by vibrating a liquid surface of ink in the head with a large voltage-amplitude waveform. By contrast, in the non-printing mode, such as the standby state, the sleep state or the like, the waveform generation circuit 46 generates a waveform similar to driving signal B as shown in FIG. 4B, such that driving signal B is applied to the piezoelectric actuators 22. Driving signal B is a waveform which is capable, with a waveform with shallow gradients and small amplitude, of preventing coagulation and solidification of the ink in the head not by ejecting the ink but by vibrating a liquid surface of the ink to agitate the ink. The control section 40 instructs the waveform generation circuit 46 so as to generate the waveform similar to driving signal A in the printing mode, and so as to generate the waveform similar to driving signal B in the non-printing mode.

Here, a frequency region of driving signal A is, as an example, around 1 MHz, and a frequency of driving signal B is, as an example, around 100 kHz. The vertical axis gradations in FIGS. 4A and 4B are 5 V. As shown in FIGS. 4A and 4B, a DC bias voltage of around 30 V is applied to the piezoelectric actuators 22.

The output terminal of the operational amplifier 11 is connected to the non-inverting output terminal of the comparator 12, which constitutes a pulse width modulator. The output terminal of the operational amplifier 11 is also connected, via a series circuit structured by a resistor R2 and a capacitor C1, to the inverting input terminal of the operational amplifier 11. A resistor R1 is connected in parallel with the series circuit structured by resistor R2 and capacitor C1.

The capacitor C1 and resistor R1 act to lower gain of the operational amplifier 11 in a high-frequency range. Thus, the bandwidth is not extended more than necessary and instability is avoided. The resistor R2 controls the gain such that output of the operational amplifier 11 does not exceed a common input range of the comparator 12. However, if the value of resistor R2 is too small, an open loop gain is lowered too far and a steady state offset arises at the outputs of the piezoelectric actuators 22. Thus, the value of resistor R2 is a trade-off between these two factors.

A triangular wave from a triangular wave generation circuit 25, which will be described later, is inputted to the inverting input terminal of the comparator 12, and the output signal of the operational amplifier 11 is inputted to the non-inverting input terminal of the comparator 12. The comparator 12 is a pulse width modulator which outputs a high-level signal when a voltage of an error signal, which is inputted to the non-inverting input terminal, is higher than a voltage of the triangular wave inputted to the inverting input terminal and which outputs a low-level signal when the error signal voltage is lower. The output terminal of the comparator 12 is connected to the input terminal of the digital voltage amplifier 13.

Figure 5:
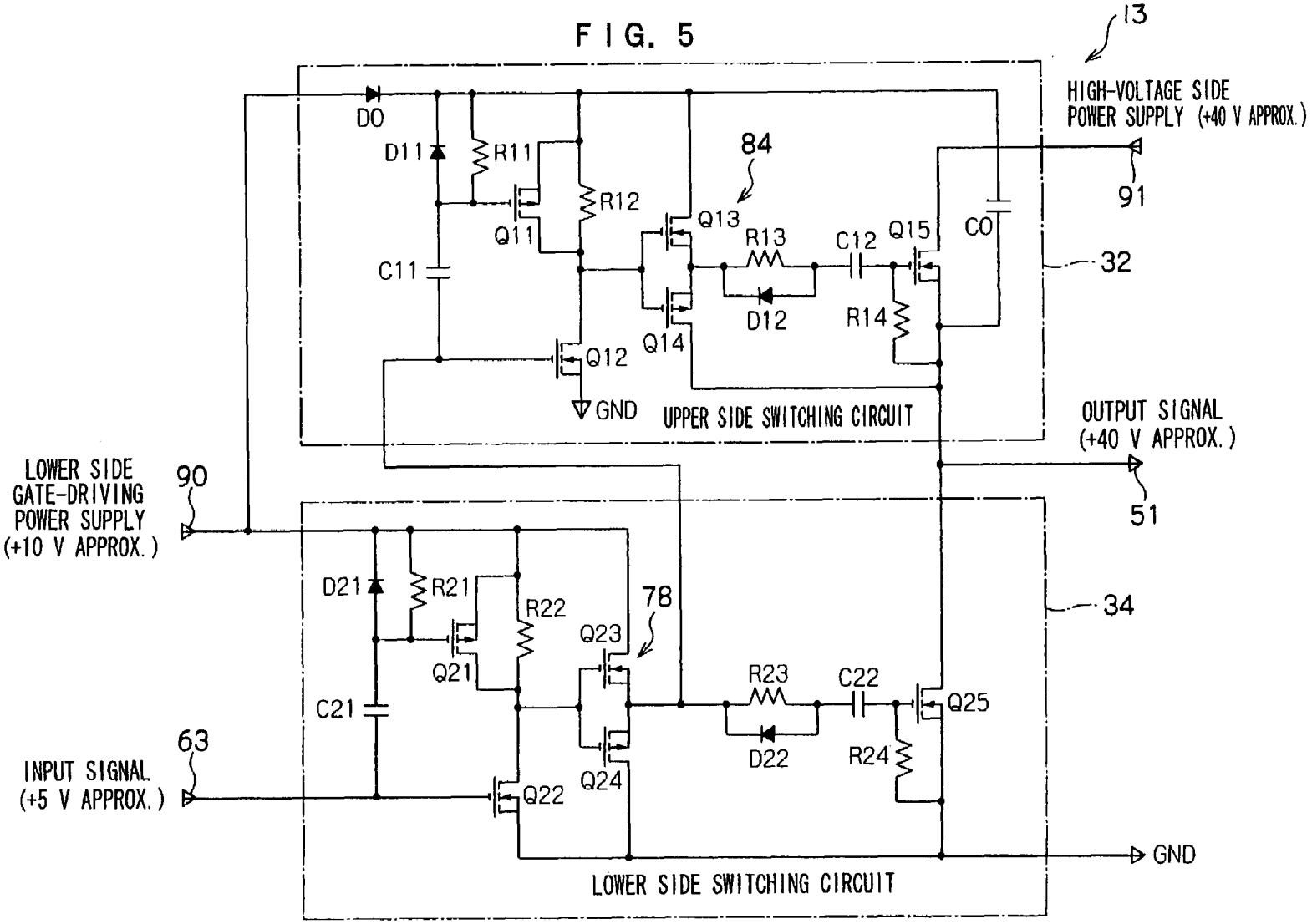
FIG. 5 is a diagram showing circuit structure of a digital voltage amplifier.

FIG. 5 is a diagram showing circuit structure of the digital voltage amplifier 13. The digital voltage amplifier 13 includes an upper side switching circuit 32 and a lower side switching circuit 34.

The upper side switching circuit 32 includes diodes D0, D11 and D12, capacitors C11 and C12, resistors R11, R12, R13 and R14, p-channel MOSFETs Q11 and Q14, and n-channel MOSFETs Q12, Q13 and Q15. The lower side switching circuit 34 includes capacitors C21 and C22, diodes D21 and D22, resistors R21, R22, R23 and R24, p-channel MOSFETs Q21 and Q24, and n-channel MOSFETs Q22, Q23 and Q25.

The gate of MOSFET Q22 is connected, via an input terminal 63, to the output terminal of the comparator 12. The source of MOSFET Q22 is connected to ground. The drain of MOSFET Q22 is connected, via resistor R22, to a lower side gate-driving power supply terminal 90, which is for driving the lower side switching circuit 34.

The drain of MOSFET Q21 is connected to the lower side gate-driving power supply terminal 90, and the source of MOSFET Q21 is connected to the drain of MOSFET Q22.

The gate of MOSFET Q21 is connected to the anode of diode D21, and the cathode of diode D21 is connected to the lower side gate-driving power supply terminal 90. Further, the gate of MOSFET Q21 is connected, via resistor R21, to the lower side gate-driving power supply terminal 90 and is also connected, via capacitor C21, to the input terminal 63.

The gates of MOSFETs Q23 and Q24 are connected together to structure a push-pull type buffer circuit 78. The drain of MOSFET Q23 is connected to the lower side gate-driving power supply terminal 90, the source of MOSFET Q23 is connected to the drain of MOSFET Q24, and the source of MOSFET Q24 is connected to ground.

Accordingly, the gates of MOSFETs Q23 and Q24 act as an input terminal of the push-pull type buffer circuit 78, and the source of MOSFET Q23 and drain of MOSFET Q24 act as an output terminal of the push-pull type buffer circuit 78. The input terminal of the push-pull type buffer circuit 78 is connected, via resistor R22 to the lower side gate-driving power supply terminal 90.

The output terminal of the push-pull type buffer circuit 78 is connected to the gate of MOSFET Q25 via a parallel circuit, which is structured by resistor R23 and diode D22, and capacitor C22. Here, the cathode of the diode D22 is connected to the output terminal of the push-pull type buffer circuit 78, and the anode is connected to capacitor C22. The source of MOSFET Q25 is connected to ground, the drain of MOSFET Q25 is connected to an output terminal 51, and the gate of MOSFET Q25 is connected to ground via resistor R24.

The upper side switching circuit 32 has a substantially similar structure to the lower side switching circuit 34. Therefore, detailed structure of the upper side switching circuit 32 will not be described. Principally, connections that differ from the lower side switching circuit 34 will be described.

The capacitors C11 and C12, diodes D11 and D12, resistors R11, R12, R13 and R14, and MOSFETs Q11, Q12, Q13 and Q14 of the upper side switching circuit 32 correspond, respectively, to the capacitors C21 and C22, diodes D21 and D22, resistors R21, R2, R23 and R24, and MOSFETs Q21, Q22, Q23 and Q24 of the lower side switching circuit 34. A push-pull type buffer circuit 84, which is structured by MOSFET Q13 and MOSFET Q14, corresponds to the push-pull type buffer circuit 78.

The gate of MOSFET Q12 is connected to the output terminal of the push-pull type buffer circuit 78 rather than the input terminal 63. The source of MOSFET Q12 is connected to ground. The sources of MOSFETs Q14 and Q15 are connected to the output terminal 51, and the drain of MOSFET Q15 is connected to a high-voltage side power supply (main power supply) terminal 91, for amplifying current.

The cathode of diode D11, resistors R11 and R12, and the drain of MOSFET Q13 are all connected to the lower side gate-driving power supply terminal 90 via diode D0, with the anode of diode D0 being connected to the lower side gate-driving power supply terminal 90. The lower side gate-driving power supply terminal 90 is also connected to the source of MOSFET Q15, via diode D0 and a capacitor C0.

As shown in FIG. 3, the output terminal of the digital voltage amplifier 13 is connected to the filter 14. The filter 14 is provided with an inductor L1, a resistor R3 and a capacitor C2. Inductor L1 is connected to the output terminal of the digital voltage amplifier 13, and resistor R3 is connected to an output side of inductor L1. One end of capacitor C2 is connected to an output side of resistor R3 and the other end is connected to ground. The filter 14 functions as a low-pass filter which applies a smoothing process to signals inputted to inductor L1, and outputs the smoothed signals from resistor R3. The filter 14, being provided with two elements for attenuating a high frequency range—the circuit structured by resistor R3 and capacitor C2, and the inductor L1—acts as a second order delay element.

The output terminal of the filter 14 is connected to the transmission gates $21_1$ to $21_n$ of the head 2. The n transmission gates $21_1$ to $21_n$ are connected to the n piezoelectric actuators $22_1$ to $22_n$ corresponding to the respective transmission gates 21. Other terminals of the piezoelectric actuators $22_1$ to $22_n$ are connected to ground.

The output terminal of the filter 14 is also connected to the inverting input terminal of the operational amplifier 11, via a feedback circuit 15, an operational amplifier 17, and a resistor R7. The feedback circuit 15 is provided with a capacitor C3 and a resistor R4, which are connected in parallel, and a resistor R6, one end of which is connected to an output side of resistor R4 and the other end of which is connected to ground. Resistors R4 and R6 voltage-divide an output voltage of the filter 14 (i.e., a terminal voltage of the piezoelectric actuators 22). The parallel circuit of capacitor C3 and resistor R4 implements a phase adjustment from the output terminal of the filter 14.

The inverting input terminal of the operational amplifier 17 is connected to the output terminal of the same. The non-inverting input terminal of the operational amplifier 17 is connected to the output side of the feedback circuit 15 (i.e., the output side of resistor R4). Accordingly, the operational amplifier 17 functions as an impedance conversion circuit with a voltage gain of 1.

Now, values of the capacitor C3 and resistors R4 and R6 of the filter 14 affect a process of determining values for the resistors R1 and R2 and capacitor C1 which are connected to the operational amplifier 11. In consequence, it might be difficult to assure adequate open loop gain with any particular values.

However, the operational amplifier 17, being an impedance conversion circuit, is a 'buffer circuit' which buffers the feedback circuit 15 from the operational amplifier 11. Therefore, it is possible to separately specify fixed values for the feedback circuit 15 and fixed values for C1, R1 and R2 at the operational amplifier 11, and adequate open loop gain can be assured. As a result, it is possible to structure a circuit with no steady-state offset and with good tracking.

At the filter 14, because the piezoelectric actuators $22_1$ to $22_n$ are connected in parallel, a cutoff frequency of the filter 14 varies. However, by including the filter 14 and the piezoelectric actuators $22_1$ to $22_n$ in a closed loop, it is possible to suppress changes in the cutoff frequency.

Thus, the driving circuit 1 has a structure which includes the digital voltage amplifier 13 which employs a switching circuit, that is to say, is a D class amplifier. Therefore, in comparison with conventional A/B class amplifiers, the device can be structured more compactly.

Although the driving circuit 1 of the present embodiment has a structure which includes the feedback circuit 15, in cases in which this is not necessary, a structure in which a driving signal is directly inputted to the comparator 12 is also possible.

Next, a frequency alteration section 24 and the triangular wave generation circuit 25 will be described.

Figure 6:
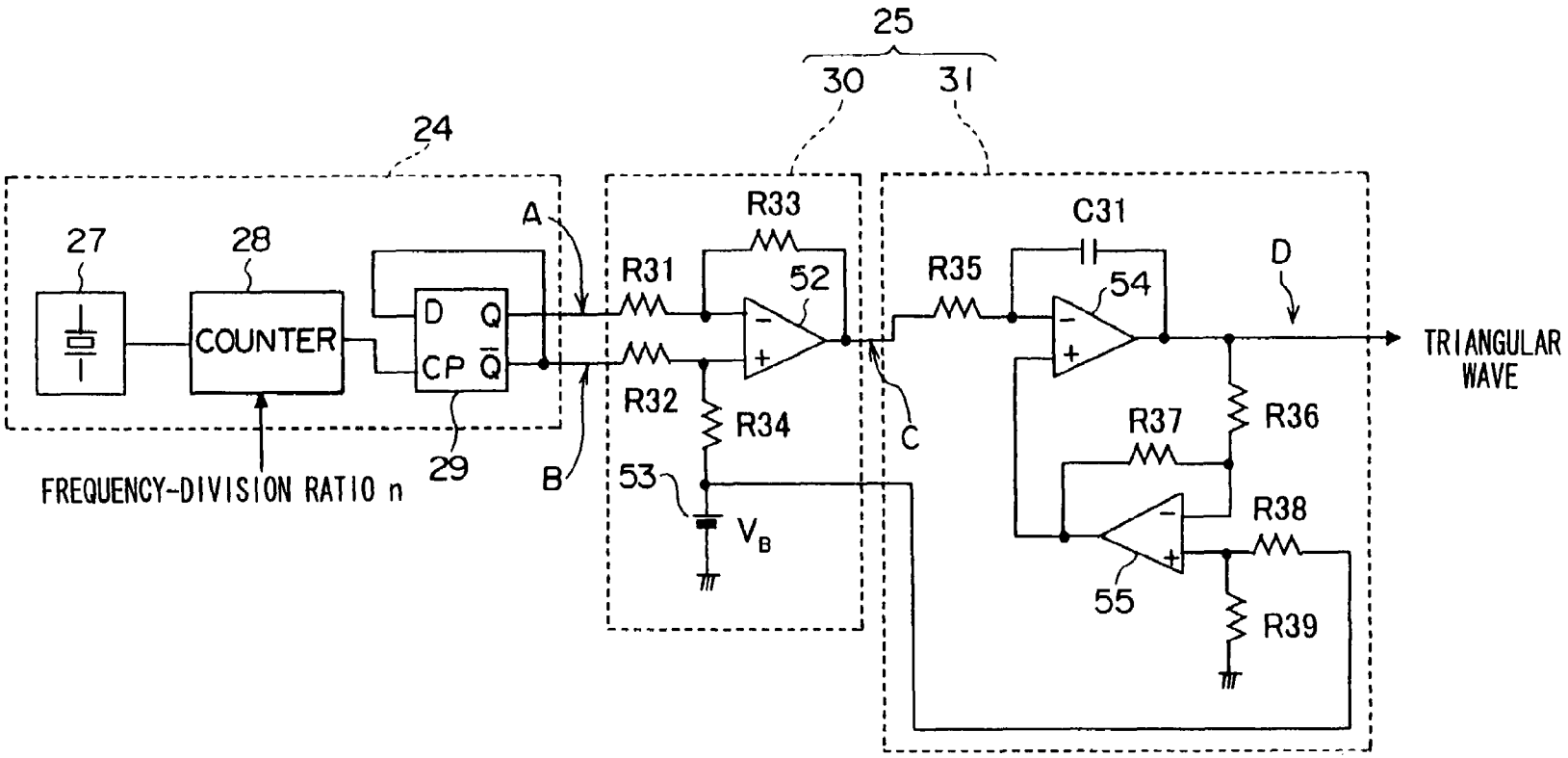
FIG. 6 is a circuit diagram of a frequency alteration section and a triangular wave generation circuit.

FIG. 6 shows a circuit diagram of the frequency alteration section 24 and the triangular wave generation circuit 25. The frequency alteration section 24 is structured with a square waveform oscillation circuit 27, a counter 28 and a D flip-flop 29.

The square waveform oscillation circuit 27 is structured by, for example, a quartz oscillator, and outputs a square wave with a predetermined frequency f (for example, 5 MHz). The amplitude of the square wave is 0 to Vcc volts (for example, 3.3 V or 5 V). The counter 28 frequency-divides the square waveform from the square waveform oscillation circuit 27 by a frequency-division ratio n, which is a frequency selection signal that has been output from the control section 40 via the port 42. The counter 28 outputs the frequency-divided waveform to the D flip-flop 29. In other words, the counter 28 outputs a square waveform with frequency f/n to a clock pulse input terminal CP of the D flip-flop 29.

An output terminal Q', which outputs a signal in which an output signal which is output from an output terminal Q is inverted, is connected to an input terminal D of the D flip-flop 29. Accordingly, a square waveform as shown in FIG. 7A, in which the square waveform with frequency f/n that is output from the counter 28 is frequency-divided by 2, is output from the output terminal Q of the D flip-flop 29, and a square waveform as shown in FIG. 7B, in which the square waveform output from the output terminal Q is inverted, is output from the output terminal Q'.

The triangular wave generation circuit 25 is structured with a differential amplifier 30 and an integrated circuit 31.

The differential amplifier 30 is structured with resistors R31, R32, R33 and R34, an operational amplifier 52 and a DC power supply 53, which outputs a bias voltage $V_B$. One end of R31 is connected to the output terminal Q of the D flip-flop 29, and the other end is connected to the inverting input terminal of the operational amplifier 52. One end of resistor R32 is connected to the Q' output terminal of the D flip-flop 29, and the other end is connected to the non-inverting input terminal of the operational amplifier 52. One end of resistor R33 is connected to the inverting input terminal of the operational amplifier 52, and the other end is connected to the output terminal of the operational amplifier 52. One end of resistor R34 is connected to the non-inverting input terminal of the operational amplifier 52, and the other end is connected to the positive side of the DC power supply 53.

Figure 7:
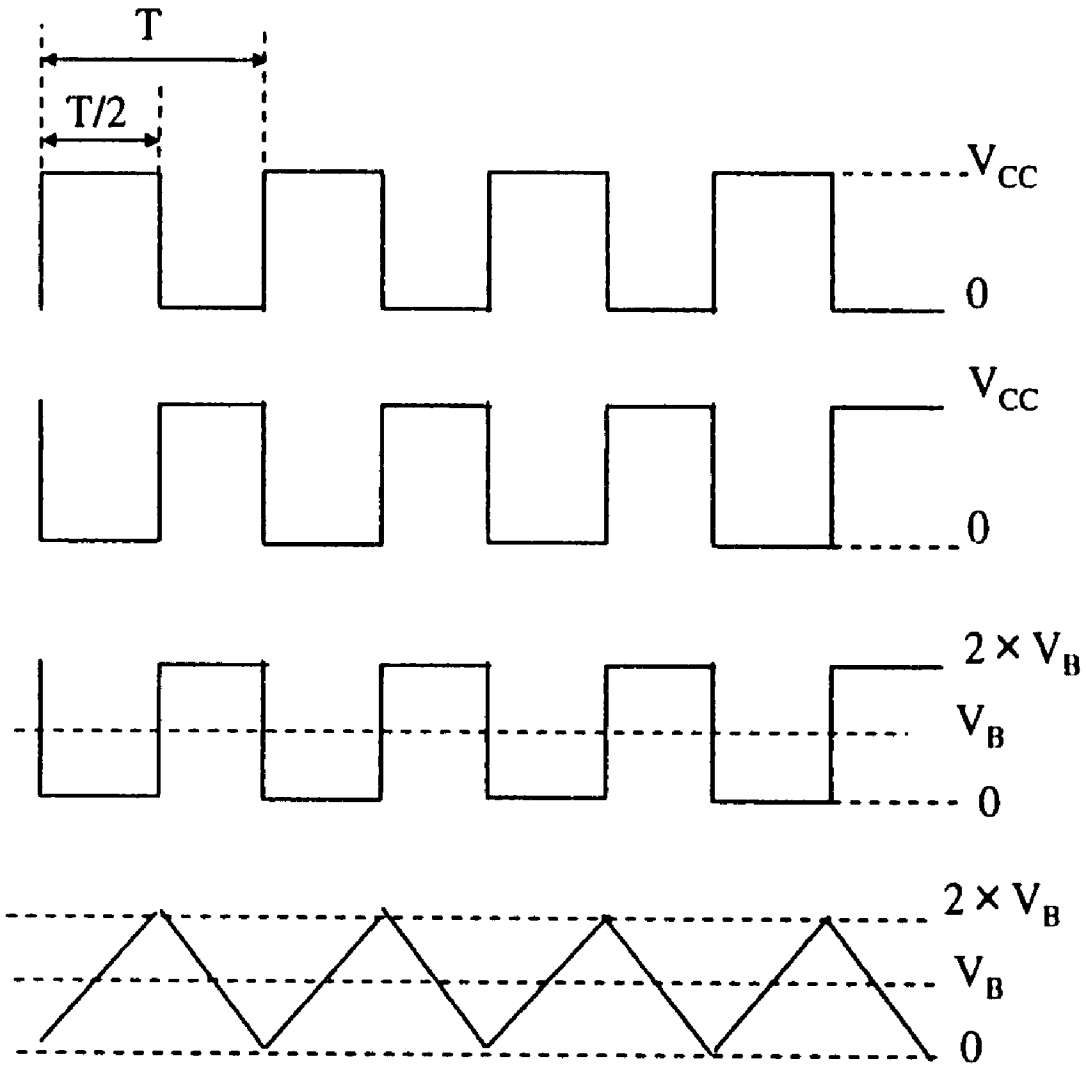
FIGS. 7A, 7B, 7C and 7D are waveform diagrams of voltages at locations of the voltage alteration section and triangular wave generation circuit.

The differential amplifier 30 removes DC components of the inputted square waveforms and outputs a square waveform as shown in FIG. 7C, to which the bias voltage $V_B$ is applied, to the integrated circuit 31.

The integrated circuit 31 is structured with resistors R35, R36, R37, R38 and R39, operational amplifiers 54 and 55, and a capacitor C31. One end of resistor R35 is connected to the output terminal of the operational amplifier 52, and the other end is connected to the inverting input terminal of the operational amplifier 54. One end of capacitor C31 is connected to the inverting input terminal of the operational amplifier 54, and the other end is connected to the output terminal of the operational amplifier 54. One end of resistor R36 is connected to the output terminal of the operational amplifier 54, and the other end is connected to the inverting input terminal of the operational amplifier 55. One end of resistor R37 is connected to the inverting input terminal of the operational amplifier 55, and the other end is connected to the output terminal of the operational amplifier 55. One end of resistor R38 is connected to the non-inverting input terminal of the operational amplifier 55, and the other end is connected to the positive side of the DC power supply 53. One end of resistor R39 is connected to the inverting input terminal of the operational amplifier 55, and the other end is connected to ground. The output terminal of the operational amplifier 55 is connected to the non-inverting input terminal of the operational amplifier 54.

The integrated circuit 31 that is formed thus integrates the square waveform output from the differential amplifier 30 with reference to the bias voltage $V_B$, and outputs a triangular waveform as shown in FIG. 7D. With an integrated circuit with a structure in which the inverting input terminal of the operational amplifier 54 was connected to ground, as would be conventional, there would be infinite gain with respect to direct current, and consequently output would stabilize with a small DC offset at the input. Accordingly, the integrated circuit 31 of the present embodiment has a structure in which an offset-canceling circuit, with the operational amplifier 55, is added.

Next, operation of the droplet ejection device will be described.

As shown in FIG. 3, the operational amplifier 11 outputs, to the non-inverting input terminal of the comparator 12, an error signal between an analog driving signal which is inputted to the non-inverting input terminal thereof and a signal for which a terminal voltage of the piezoelectric actuators 22 is fed back via the feedback circuit 15, the operational amplifier 17 and resistor R7.

On the basis of the error signal from the operational amplifier 11 which is inputted to the non-inverting input terminal of the comparator 12 and the triangular wave which is inputted to the inverting input terminal of the same, the comparator 12 performs pulse width modulation. Hence, the comparator 12 outputs a digital signal, with duty ratios based on variations in the voltage of the error signal that is inputted to the non-inverting input terminal, to the digital voltage amplifier 13.

Therefore, if the terminal voltage of the piezoelectric actuators 22 rises, the level of the error signal at the operational amplifier 11 falls. Hence, the duty ratio of the digital signal that is output from the comparator 12 falls, and the terminal voltage of the piezoelectric actuators 22 also falls. In other words, the comparator 12 performs control such that the voltage of the error signal at the operational amplifier 11 becomes zero.

The digital voltage amplifier 13 amplifies voltage and current of the digital signal that the comparator 12 outputs to a power which is capable of driving the piezoelectric actuators 22 (for example, a voltage from around 20 V to 40 V) by switching operations. The filter 14 smoothes output from the digital voltage amplifier 13, and outputs the result to each of the transmission gates $\mathbf{21}_1$ to $\mathbf{21}_n$ of the head 2.

The power-amplified driving signal is inputted to the transmission gates $\mathbf{21}_1$ to $\mathbf{21}_n$, and voltages based on image data are applied to the transmission gates $\mathbf{21}_1$ to $\mathbf{21}_n$. Thus, a driving voltage is applied to the piezoelectric actuators $\mathbf{22}_1$ to $\mathbf{22}_n$ which are correspondingly connected with the respective transmission gates $\mathbf{21}_1$ to $\mathbf{21}_n$.

Because the piezoelectric actuators $\mathbf{22}_1$ to $\mathbf{22}_n$ are capacitive loads, the cutoff frequency of the filter 14 may change in accordance with changes in numbers of the piezoelectric actuators $\mathbf{22}_1$ to $\mathbf{22}_n$ which are simultaneously driven according to the image data. Specifically, the capacitor C2 which structures the filter 14 and the piezoelectric actuators $\mathbf{22}_1$ to $\mathbf{22}_n$ which are capacitive loads are connected in parallel. Therefore, when the number of the piezoelectric actuators $\mathbf{22}_1$ to $\mathbf{22}_n$ that are being driven simultaneously changes, a load at the filter 14 changes, and the cutoff frequency may change.

However, the signal which is output from the filter 14 (i.e., the terminal voltage of the piezoelectric actuators 22) feeds back to the inverting input terminal of the operational amplifier 11 through the feedback circuit 15 and the operational amplifier 17. Accordingly, changes in the cutoff frequency of the filter 14 can be suppressed. Moreover, because changes in the cutoff frequency of the filter 14 are suppressed, the terminal voltage of the piezoelectric actuators $\mathbf{22}_1$ to $\mathbf{22}_n$ can be compensated so as to be substantially constant.

Next, operation of the digital voltage amplifier 13 will be described.

When the digital signal which is inputted through the input terminal 63 is at the high level, at the MOSFET Q22 of the lower side switching circuit 34, the gate voltage is higher than the source voltage and MOSFET Q22 is turned on. At this time, because the drain voltage of MOSFET Q22 and the source voltage of MOSFET Q25 are the same, MOSFET Q25 is turned off.

Because MOSFET Q22 of the lower side switching circuit 34 is on when the digital signal inputted from the input terminal 63 is at the high level, a ground level, that is, low level voltage is inputted to the gate of MOSFET Q12 of the upper side switching circuit 32.

Because the source of MOSFET Q12 is connected to ground, MOSFET Q12 is then turned off. When MOSFET Q12 is off, the power supply voltage from the lower side gate-driving power supply terminal 90 is inputted to the source of MOSFET Q15. In a state in which no charge at all is stored at capacitor C0, the gate voltage of MOSFET Q15 is larger than the source voltage, and thus MOSFET Q15 is turned on.

Therefore, when the digital signal inputted from the input terminal 63 is at the high level, MOSFET Q15 of the upper side switching circuit 32 is on and MOSFET Q25 of the lower side switching circuit 34 is off, and-the upper side switching circuit 32 is in a conducting state. At this time, because MOSFET Q25 is off, the lower side switching circuit 34 is in an open state.

Thus, when the digital signal inputted to the input terminal 63 is at the high level, the digital voltage amplifier 13 acts as a positive logic power amplification circuit overall, and the upper side switching circuit 32 charges up the piezoelectric actuators $22_1$ to $22_n$.

In contrast, when the digital signal which is inputted through the input terminal 63 is at the low level, MOSFET Q15 of the upper side switching circuit 32 is turned off and MOSFET Q25 of the lower side switching circuit 34 is turned on. Thus, the lower side switching circuit 34 is in a conducting state. At such a time, the upper side switching circuit 32 is in an open state.

Therefore, when the digital signal inputted to the input terminal 63 is at the low level, the lower side switching circuit 34 discharges the piezoelectric actuators $22_1$ to $22_n$, while the upper side switching circuit 32 is in the open state.

Thus, when the digital signal inputted to the input terminal 63 is at the low level, the digital voltage amplifier 13 acts as a negative logic power amplification circuit overall, and the lower side switching circuit 34 draws charge from the piezoelectric actuators $22_1$ to $22_n$.

In this manner, the digital voltage amplifier 13 uses digital operations, which is to say switching operations, to perform voltage amplification and current amplification. Consequently, in comparison with a conventional power amplifier which voltage-amplifies and current-amplifies analog signals, it is possible to restrain heat generation during power amplification.

The series circuit which is structured by the MOSFET Q12 and resistor R12 of the upper side switching circuit 32 is a circuit for amplifying voltage of digital signals, and performs voltage amplification in accordance with the digital signals inputted through the input terminal 63.

When a digital signal inputted from the input terminal 63 is at the high level, MOSFET Q12 is turned off. When MOSFET Q12 is off, the power supply voltage from the lower side gate-driving power supply terminal 90 is inputted through resistor R12, voltage amplification is implemented by the series circuit structured by resistor R12 and MOSFET Q12, and the voltage is then output to the buffer circuit 84.

Now, when the digital signal inputted from the input terminal 63 changes from the low level to the high level, MOSFET Q12 switches from on to off. In a transitional state in which MOSFET Q12 is switching from on to off, power from the lower side gate-driving power supply terminal 90 is applied, via resistor R12, to a feedback capacitance between the gate and drain of MOSFET Q12. Here, the gate-drain feedback capacitance of MOSFET Q12 is of the order of a few pF, and in order to operate MOSFET Q12 at high speed, it is necessary to set the value of resistor R12 to a small value, for example, 1 kΩ. However, if current from the lower side gate-driving power supply terminal 90 flows via resistor RI 2 to the gate-drain feedback capacitance of MOSFET Q12 in the transition state in which MOSFET Q12 is switching from on to off, large amounts of heat, of the order of 1 W, may be generated.

In order to suppress this heat generation, it is necessary to make the value of resistor R12 large, but if the value of resistor R12 is made larger, it becomes difficult to operate MOSFET Q12 at high speed.

Accordingly, in the present exemplary embodiment, the MOSFET Q11 is connected so as to turn on when the digital signal inputted from the input terminal 63 is at the low level, and so as to, when turned on, short-circuit resistor R12 in the path from the lower side gate-driving power supply terminal 90 to the drain of MOSFET Q12. Further, the value of resistor R12 is set to be large. For example, the value of resistor R12 is set to 10 kΩ or more for the present embodiment. When the digital signal inputted through the input terminal 63 is at the low level, MOSFET Q11 is turned on, and thus resistor R12 is shorted out and current from the lower side gate-driving power supply terminal 90 flows through resistor R11 to the drain of MOSFET Q12.

Thus, by setting the value of resistor R12 to be larger and providing MOSFET Q11 such that MOSFET Q11 short-circuits resistor R12 when the digital signal inputted through the input terminal 63 is at the low level, it is possible to provide a detour circuit, which does not pass through resistor R12, for when the digital signal it is at the low level. Thus, it is possible both to suppress heating and to operate MOSFET Q12 at high speeds.

If the resistance of resistor R12 were large and MOSFET Q13 and MOSFET Q14 were structured by bipolar transistors, current supply to MOSFET Q13 and MOSFET Q14 would be difficult. Thus, in the present embodiment, MOSFET Q13 and MOSFET Q14 are structured by an n-channel MOSFET and a p-channel MOSFET.

When the digital signal inputted from the input terminal 63 is at the high level, power supplied from the lower side gate-driving power supply terminal 90 and a substantially equivalent pinch-off voltage are applied to the capacitor C11. When the digital signal inputted from the input terminal 63 is at the low level, MOSFET Q12 is turned on, and a gate voltage of MOSFET Q11 is reduced for a short period. When the gate voltage of MOSFET Q11 is reduced for the short period, a lower side terminal voltage of capacitor C11 falls, and an input capacitance between the gate and source of MOSFET Q12 rapidly discharges. Therefore, even though MOSFET Q11 is structured by a p-channel MOSFET, it is possible to operate MOSFET Q11 at fast speeds.

The anode of diode D11 is connected to capacitor C11 and the cathode of diode D11 is connected to the lower side gate-driving power supply terminal 90. Because the diode D11 is connected thus, the gate voltage of MOSFET Q12 rises and it is possible to prevent a reverse bias being applied to the lower side gate-driving power supply terminal 90.

Thus, with the above-described capacitor C11, diode D11, resistor R11, MOSFET Q11, resistor R12 and MOSFET Q12, which function as an upper side voltage amplification circuit, a series circuit, which functions as a voltage amplification circuit, is structured by resistor R12 and MOSFET Q12, which turns on when the digital signal inputted through the input terminal 63 is at the low level, being connected in series. The resistance of resistor R12 is specified so as to be large, and MOSFET Q11 is connected so as to short out resistor R12 by turning on when the digital signal is at the low level. Hence, it is both possible to avoid heating of the series circuit and possible to operate MOSFET Q12 at high speeds.

Moreover, because it is possible to discharge the gate-source capacitance of MOSFET Q11 at high speed with capacitor C11, it is possible to operate MOSFET Q11 at a fast speed. Moreover yet, with diode D11, it is possible to prevent a reverse bias being applied to the lower side gate-driving power supply terminal 90.

Next, operations of MOSFET Q13, MOSFET Q14, resistor R13, diode D12, capacitor C12 and resistor R14 of the upper side switching circuit 32, and operation of MOSFET Q15, which functions as an upper side switching element, will be described.

As described above, when the digital signal inputted through the input terminal 63 is at the high level, MOSFET Q12 is off and voltage amplification is implemented by the series circuit which is structured by resistor R12 and MOSFET Q12. The voltage-amplified signal is output to the buffer circuit 84.

The buffer circuit 84, being a push-pull type buffer circuit formed of MOSFET Q13 and MOSFET Q14, current-amplifies the voltage-amplified signal. The voltage-amplified and current-amplified signal is output through resistor R13 and capacitor C12 to the gate of MOSFET Q15. When the digital signal inputted through the input terminal 63 is at the high level, MOSFET Q15 is turned on, and the voltage-amplified and current-amplified signal is output from the output terminal 51. Therefore, the upper side switching circuit 32 charges the piezoelectric actuators $\mathbf{22}_1$ to $\mathbf{22}_n$.

In the present exemplary embodiment, because an n-channel MOSFET, which operates several times faster than a p-channel MOSFET, is employed at MOSFET Q15, it is possible to perform rapid switching operations.

Further, a MOSFET has an input capacitance between the gate and source. Therefore, in order to operate MOSFET Q15 at high speeds, it is necessary to perform rapid charging and discharging of the gate-source input capacitance of MOSFET Q15.

In the present exemplary embodiment, MOSFET Q13 and MOSFET Q14, which function as a current amplification circuit, are structured as the push-pull type buffer circuit. Because this circuit constitutes a source follower with a low output impedance, it is possible to perform charging and discharging of the gate-source input capacitance of MOSFET Q15 quickly, and high-speed operations of MOSFET Q15 can be executed.

Furthermore, in the present exemplary embodiment, resistor R13 is connected between MOSFET Q15 and the push-pull type buffer circuit structured by MOSFET Q13 and MOSFET Q14. If charging or discharging of the gate-source input capacitance of MOSFET Q15 was too fast, a large current would momentarily flow, and noise might be generated as a result. However, with resistor R13, a rate of current flowing between the buffer circuit 84 and MOSFET Q15 can be suppressed, and thus a speed of charging of the gate-source input capacitance of MOSFET Q15 can be restrained, and the generation of noise can be suppressed.

In general, MOSFET Q15 of the upper side switching circuit 32 and MOSFET Q25 of the lower side switching circuit 34 will not be on at the same time. However, if high-speed operation of MOSFET Q15 is realized and high-speed operation of the MOSFET Q25, of a similarly structured lower side current amplification circuit of the lower side switching circuit 34, is also realized, then there is a chance that turn-on periods and turn-off periods of MOSFET Q15 and MOSFET Q25 will overlap. At a time in which the turn-on period and turn-off period of MOSFET Q15 and MOSFET Q25 overlapped, the upper side switching circuit 32 and the lower side switching circuit 34 would both be in the conducting state, which, as well as leading to erroneous operations, could damage the elements.

In the present exemplary embodiment, the diode D12 is additionally connected, so as to short out resistor R13 when the gate-source input capacitance of MOSFET Q15 is being discharged. Consequently, because it is possible to rapidly discharge the input capacitance of MOSFET Q15, the turn-on period of MOSFET Q15 can be slowed and the turn-off period made quicker. In addition, capacitor C12 is connected between resistor R13 and MOSFET Q15. Because capacitor C12 is connected between resistor R13 and MOSFET Q15, a series circuit is structured by the gate-source input capacitance of MOSFET Q15 and the capacitor C12, the gate-source input capacitance of MOSFET Q15 discharges more rapidly, and the turn-off period of MOSFET Q15 can be made quicker.

Thus, with MOSFET Q15 of the upper side current amplification circuit being structured by an n-channel MOSFET, it is possible to operate MOSFET Q15 rapidly. Further, because the push-pull type buffer circuit 84 structured by MOSFET Q13 and MOSFET Q14 is provided at the upper side current amplification circuit, it is possible to charge and discharge the gate-source input capacitance of MOSFET Q15 rapidly. Further still, because the push-pull type buffer circuit 84 structured by MOSFET Q13 and MOSFET Q14, which functions as the current amplification circuit, is connected in series with MOSFET Q15, via resistor R13 and capacitor C12, and because diode D12 is provided so as to short out resistor R13 during discharging of the input capacitance of MOSFET Q15, a charging speed of the input capacitance of MOSFET Q15 can be suppressed and the turn-on period of MOSFET Q15 slowed, while the turn-off period can be made quicker.

Because the turn-on periods of MOSFET Q15 and MOSFET Q25 can be made slower and the turn-off periods can be made quicker, it is possible to avoid the upper side switching circuit 32 and lower side switching circuit 34 being in the conducting state at the same time.

Herein, because the lower side switching circuit 34 has a similar structure to the upper side switching circuit 32, the lower side switching circuit 34 can provide similar effects to the upper side switching circuit 32.

Further, the MOSFET Q13 and MOSFET Q14 structuring the push-pull type buffer circuit 84 are both structured by MOSFETs. Thus, it is possible to raise an input impedance, with respect to resistor R12, of the series circuit structured by resistor R12 and MOSFET Q12, which functions as a voltage amplification circuit, and it is possible to suppress a fall in amplification efficiency.

Next, a bootstrap circuit, which is structured by diode D0 and capacitor C0 from the lower side gate-driving power supply terminal 90, will be described.

Because the MOSFET Q15 provided to the upper side current amplification circuit of the upper side switching circuit 32 is structured by an n-channel MOSFET, a power supply with a higher voltage than the source voltage is required as a gate-driving power supply for MOSFET Q15. The high-voltage side power supply terminal 91 is connected to the drain of MOSFET Q15.

In the present exemplary embodiment, the voltage of the digital signal that is inputted through the input terminal 63 is 5 V, the voltage of the lower side gate-driving power supply terminal 90 is 5 V, a voltage-amplified and current-amplified digital signal of 40 V is output from the output terminal 51, and the voltage of the high-voltage side power supply terminal 91 is set to 40 V.

In order to drive the MOSFET Q15 of an upper side current amplification circuit 74, it is necessary to provide a power supply with a higher voltage than the source voltage of the MOSFET Q15 as a power supply for driving MOSFET Q15 of the upper side current amplification circuit 74. For the present exemplary embodiment, a driving power supply of around 45 V would have to be separately provided. While there is no technical difficulty in providing such a high-voltage driving power supply separately from the lower side driving power supply, to serve as a gate-driving power supply for the upper side switching circuit 32, there are disadvantages with regard to cost.

Accordingly, in the present exemplary embodiment, the lower side gate-driving power supply terminal 90 is connected to the source of MOSFET Q15, via diode D0 and capacitor C0, to structure a bootstrap circuit. When the digital signal inputted from the input terminal 63 is at the low level, MOSFET Q25 of the lower side switching circuit 34 turns on and MOSFET Q15 of the upper side switching circuit 32 turns off. Accordingly, when the lower side switching circuit 34 is in the conducting state, a loop is formed from the lower side gate-driving power supply terminal 90 through diode D0 to capacitor C0, and capacitor C0 is charged up by the voltage from the lower side gate-driving power supply terminal 90.

When the digital signal inputted through the input terminal 63 switches from the low level to the high level, MOSFET Q25 of the lower side switching circuit 34 turns from on to off, and MOSFET Q15 of the upper side switching circuit 32 switches from off to on. When MOSFET Q15 starts to switch on, the source voltage of MOSFET Q15 rises, the charge which has been supplied to capacitor C0 is applied to MOSFET Q15, and MOSFET Q15 enters a state in which driving is possible. When MOSFET Q15 has completely switched on, because capacitor C0 is in a charged state, a lower side terminal voltage of capacitor C0 jumps up to approximately 45 V. In conjunction therewith, voltages of the circuit all jump up to approximately 45 V during driving of the upper side switching circuit 32. While MOSFET Q15 of the upper side current amplification circuit 74 is completely switched on, the charging loop of the capacitor C0, which extends from the lower side gate-driving power supply terminal 90 through diode D0 to capacitor C0, disappears, and the voltage-amplified, current-amplified, high-level (40 V) signal is output from the output terminal 51.

If a PNP bipolar transistor was employed at MOSFET Q11, charge of the capacitor C11 would escape through diode D11 to the forward channel between the base and emitter. Consequently, a voltage fall would occur, and it might not be possible to operate the upper side switching circuit 32. In the present embodiment however, because the MOSFET Q11 is structured by a MOSFET, this problem can be removed.

Because, as described above, diode D0 and capacitor C0 function as a bootstrap circuit, it is possible, rather than separately providing a dedicated gate-driving power supply for the upper side switching circuit 32, to drive the upper side switching circuit 32 with the lower side gate-driving power supply of the lower side switching circuit 34.

Here, for the present exemplary embodiment, a case has been described of employing the lower side gate-driving power supply of the lower side switching circuit 34. However, if a circuit is to be employed for operating the transistors that are employed (the MOSFETs) at a lower voltage, a lower voltage may be employed, such as, for example, a logic circuit power supply voltage.

The driving signal A for driving the piezoelectric actuators $\mathbf{22}_1$ to $\mathbf{22}_n$ in the running state is in the frequency region of 1 MHz. In order to perform switching operations of the digital voltage amplifier 13 at such a frequency, a switching frequency of at least around 2 MHz is required, and in practice a switching frequency of around 5 MHz is required. On the other hand, the driving signal B which drives the piezoelectric actuators $\mathbf{22}_1$ to $\mathbf{22}_n$ in a non-printing mode, such as the standby state, the sleep state or the like, is in a frequency region of around 100 kHz. Performing pulse width modulation with the switching frequency of around 5 MHz, which is for when switching driving signal A, when switching driving signal B too, which is at most around 100 kHz, is wasteful of power.

Accordingly, in the running state, the control section 40 outputs the frequency-division ratio n through the port 42 to the counter 28 of the driving circuit 1, but in the non-printing mode, which is the standby state, the sleep state or the like, the control section 40 outputs a frequency-division ratio (n×a), in which the frequency-division ratio n is multiplied by a (for example, 10 times), to the counter 28 of the driving circuit 1. As a result, the frequency of the triangular wave output from the triangular wave generation circuit 25 is lowered, and the switching frequency of the digital voltage amplifier 13 is correspondingly lowered. Therefore, power consumption in the non-printing mode can be suppressed. Further, because driving signal B is supplied to the piezoelectric actuators in the non-printing mode to prevent coagulation and solidification, maintenance operations and the like when switching from the non-printing mode to the printing mode can be simplified, and it is possible to shorten a recovery time. Consequently, a printing speed of the overall device can be improved.

Figure 8:
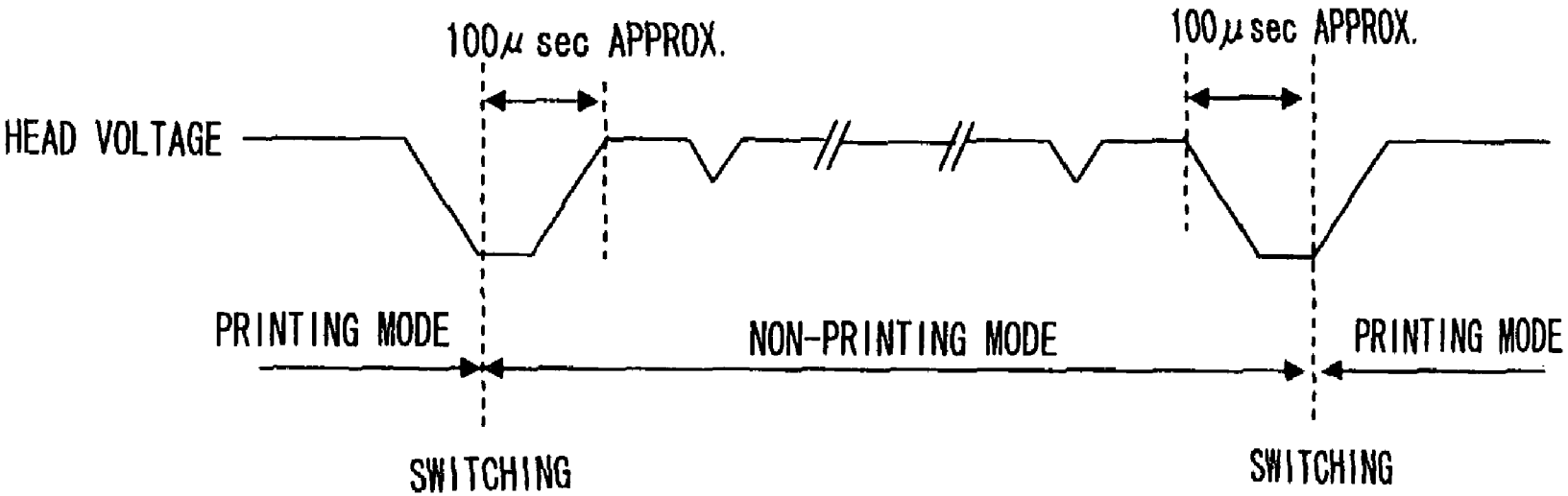
FIG. 8 is a waveform diagram for explaining voltage that is applied to a head at a time of switching between the printing mode and the non-printing mode.

As described earlier, a DC bias voltage of around 30 V is applied to the head 2, as shown in FIGS. 4A and 4B. During mode switching, that is, when shifting from the printing mode to the non-printing mode, as shown in FIG. 8, the control section 40 temporarily sets the bias to zero (discharging from the piezoelectric actuators), and then switches the frequency selection signal (i.e., the frequency-division ratio), to switch the switching frequency and shift to the non-printing mode. Here, in order to set the bias to zero, the control section 40 may instruct the waveform generation circuit 46 and output a signal to the driving circuit 1 such that the bias goes to zero. A charging/discharging duration of the piezoelectric actuators is about 100 μs or less. Thus, an overhead at the driving circuit 1 in accordance with mode-switching is of the order of a few hundred μs at most and, in comparison with a case with a conventional main power supply with an alterable switching frequency, the driving power supply can be better prevented from becoming unstable.

Figure 9:
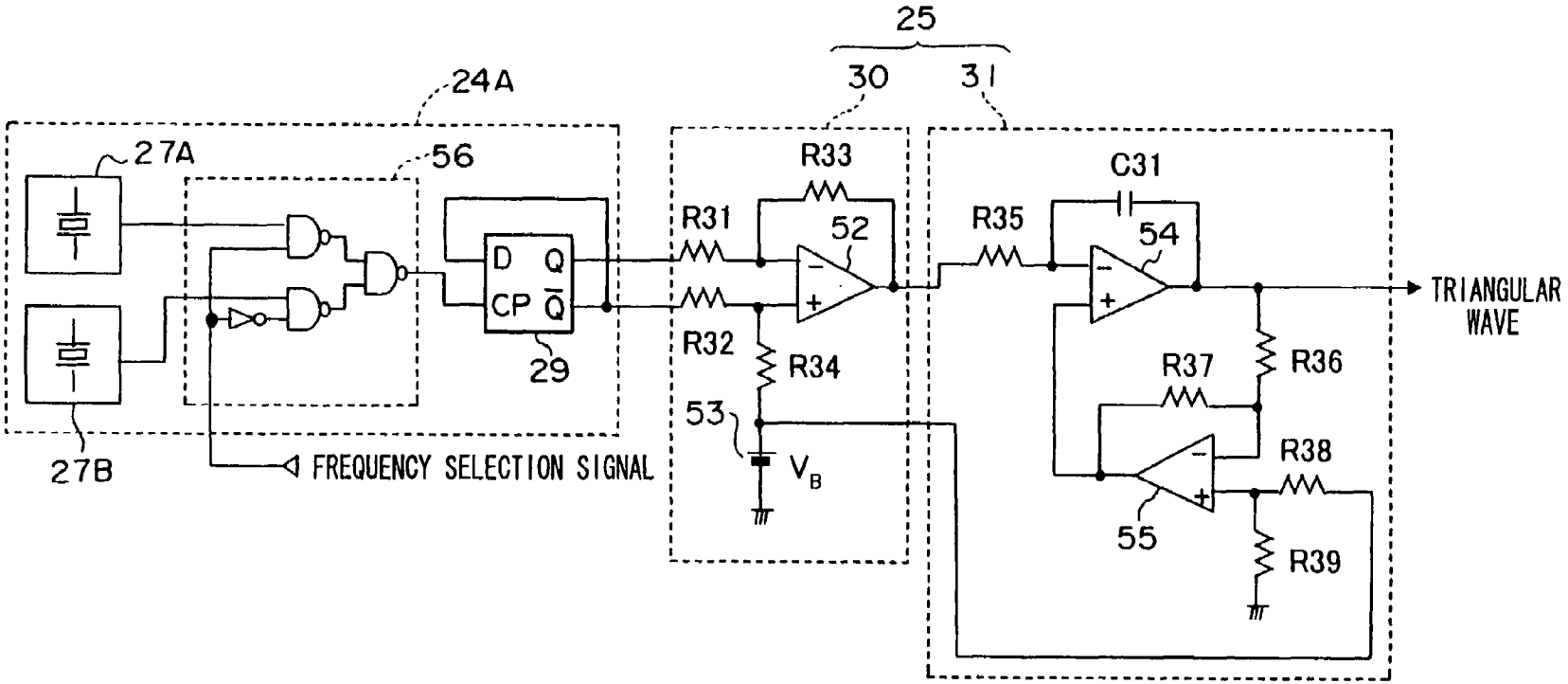
FIG. 9 is a circuit diagram of a frequency alteration section and triangular wave generation circuit relating to a variant example of the first embodiment.

Rather than using the single square waveform oscillation circuit 27 and the counter 28, as in the frequency alteration section 24 shown in FIG. 6, a structure is possible which instead utilizes two square waveform generation circuits 27A and 27B and a selector 56, as in the frequency alteration section 24A shown in FIG. 9.

In such a case, the square waveform oscillation circuit 27A may, for example, output a square waveform with a frequency required for the running state, that is, the printing mode (for example, 5 MHz). Meanwhile, the square waveform oscillation circuit 27B outputs a square waveform with a frequency required for the non-printing mode, which is the standby state, the sleep state or the like; for example, a frequency of around one-tenth the frequency of the square wave that the square waveform oscillation circuit 27A outputs.

As shown in FIG. 9, the selector 56 is structured with three NAND circuits and a NOT circuit. A frequency selection signal is a high-level or low-level signal. When the high level is inputted to the selector 56, the square waveform output from the square waveform oscillation circuit 27A is selected and output to the D flip-flop 29. On the other hand, when the low level is inputted to the selector 56, the square waveform output from the square waveform oscillation circuit 27B is selected and output to the D flip-flop 29.

The control section 40 sets the frequency selection signal to the high level for the printing mode and sets the frequency selection signal to the low level for the non-printing mode. Therefore, the frequency of the triangular wave which is output from the triangular wave generation circuit 25 is lowered in the non-printing mode, and the switching frequency of the digital voltage amplifier 13 is correspondingly lowered. As a result, power consumption in the non-printing mode can be suppressed.

Second Exemplary Embodiment

Next, a second exemplary embodiment of the present invention will be described. Herein, portions that are the same as in the first embodiment are assigned the same reference numerals, and detailed descriptions thereof will not be given.

For the second exemplary embodiment, a droplet ejection device will be described which is capable of preventing a change in amplitude of the triangular wave when the printing mode is switched to the non-printing mode and the switching frequency is lowered.

Firstly, in FIG. 6, if the upper side input voltage of the differential amplifier 30 (i.e., the voltage at position A in FIG. 6) is $V_1$, the lower side input voltage (the voltage at position B in FIG. 6) is $V_2$, the output voltage of the differential amplifier 30 (the voltage at position C in FIG. 6) is $V_3$, and the resistance values of resistors R31 to R34 are $R_{31}$, $R_{32}$, $R_{33}$ and $R_{34}$, respectively, the following equation applies.

$$V_3=k\{V_B+(V_2-V_1)\} \tag{2}$$

Therein, $$k=R_{33}/R_{31}=R_{34}/R_{32}=V_B/Vcc \tag{3}$$

Further, if the output voltage of the triangular wave generation circuit 25 (the voltage at position D in FIG. 6) is $V_4$, the resistance values of resistors R35 to R39 are $R_{35}$, $R_{36}$, $R_{37}$, $R_{38}$ and $R_{39}$, respectively, and the capacitance of capacitor C31 is $C_{31}$, the following equation applies.

$$\left[1+\left(1+\frac{1}{sC_{31}R_{35}}\right)\frac{R_{31}}{R_{36}}\right]V_4=\frac{1}{sC_{31}R_{35}}\left[\left(1+\frac{R_{37}}{R_{36}}\right)\frac{R_{39}}{R_{38}+R_{39}}V_4-V_3\right]+\left(1+\frac{R_{37}}{R_{36}}\right)\frac{R_{39}}{R_{38}+R_{39}}V_4 \tag{4}$$

Now, if $R_{37}<<R_{36}$ and $R_{38}<<R_{39}$, a relationship between the amplitude (voltage) $V_3$ of the square wave and the amplitude (voltage) $V_4$ of the triangular wave is expressed by the following equation.

$$V_4=\frac{1}{sC_{31}R_{35}}(V_B-V_3)+V_B \tag{5}$$

Further, a relationship between the amplitude $V_4$ and a frequency f (=1/T) of the triangular wave is expressed by the following equation.

$$V_4=\frac{1}{C_{31}R_{35}}\frac{1}{2f}V_3 \tag{6}$$

Therefore, to prevent the amplitude $V_4$ of the triangular wave changing when the switching frequency f is lowered, it is necessary to make the capacitance $C_{31}$ of capacitor C31 or the resistance $R_{35}$ of resistor R35 larger.

Figure 10:
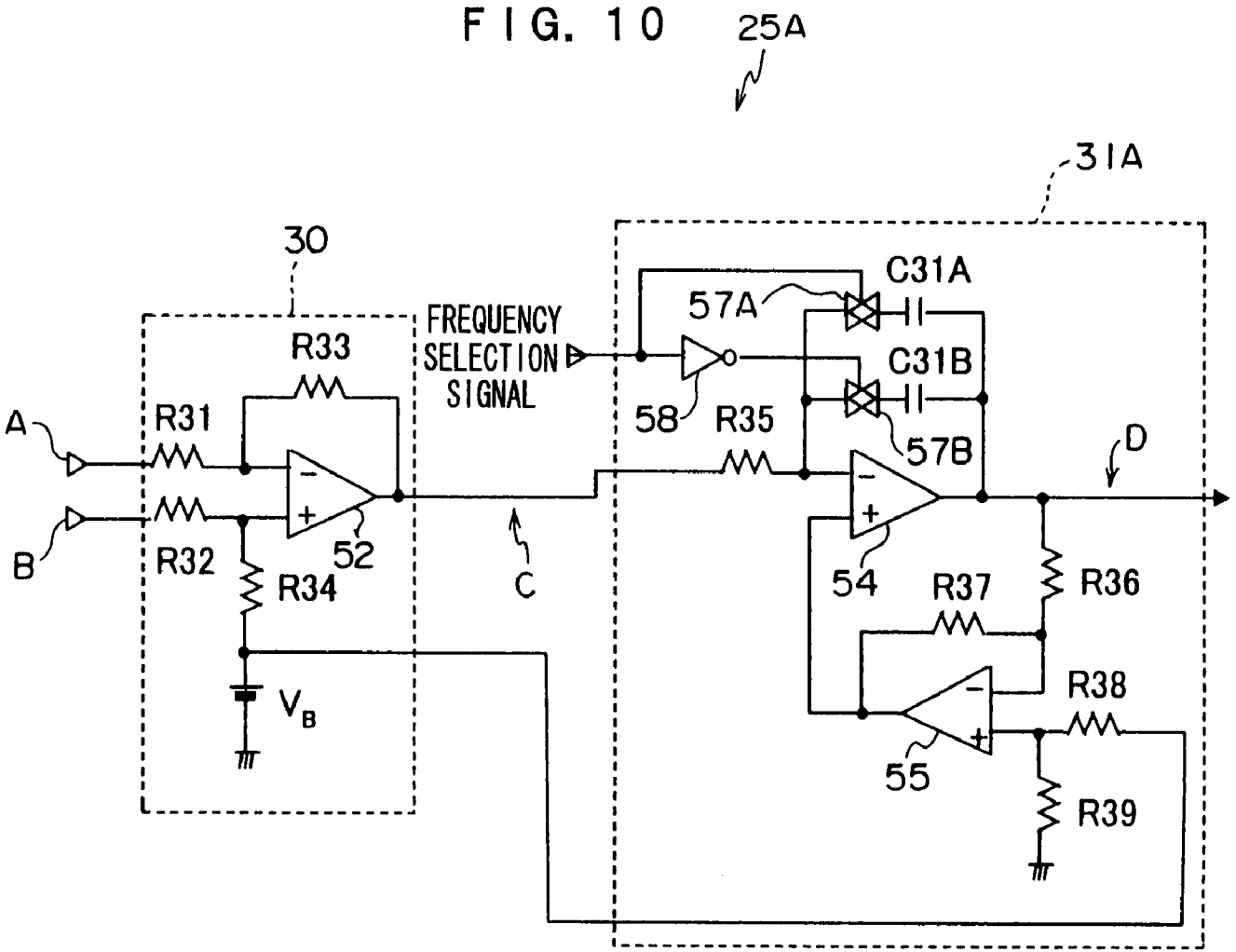
FIG. 10 is a circuit diagram of a triangular wave generation circuit relating to a second exemplary embodiment.

Accordingly, in the present embodiment, an integrated circuit of the triangular wave generation circuit is structured as shown in FIG. 10.

In an integrated circuit 31A of the triangular wave generation circuit 25A, which is shown in FIG. 10, a circuit in which a capacitor C31A and an analog switch 57A are connected in series and a circuit in which a capacitor C31B and an analog switch 57B are connected in series are connected in parallel between the inverting input terminal and the output terminal of the operational amplifier 54.

Here, the capacitor C31A has a capacitance with which operations are proper in the running state, that is, the printing mode, and capacitor C31B has a capacitance with which operations are proper in the non-printing mode, which is the standby state, the sleep state or the like. That is, capacitor C31B is a capacitor with a capacitance such that the amplitude $V_4$ of the triangular wave does not change when the switching frequency f is reduced, and has a capacitance larger than the capacitance of capacitor C31A.

The frequency selection signal is inputted to the analog switch 57A, and a signal in which the frequency selection signal has been inverted by a NOT circuit 58 is inputted to the analog switch 57B. Thus, when the frequency selection signal is at the high level, the analog switch 57A is turned on (conducting), the analog switch 57B is turned off (non-conducting), and capacitor C31A is selected. When the frequency selection signal is at the low level, the analog switch 57B is turned on, the analog switch 57A is turned off, and the capacitor C31B is selected.

Thus, by switching between capacitors with different capacitances with the frequency selection signal, it is possible to make the amplitude of the triangular wave invariable, even when switching from the printing mode to the non-printing mode and lowering the switching frequency. If this integrated circuit 31A is combined with the frequency alteration section 24 shown in FIG. 6, the control section 40 may, at a time of mode-switching, switch the frequency selection signal shown in FIG. 10 in synchronization with the switching of the frequency-division ratio n which is output through the port 42 to the counter 28.

Figure 11:
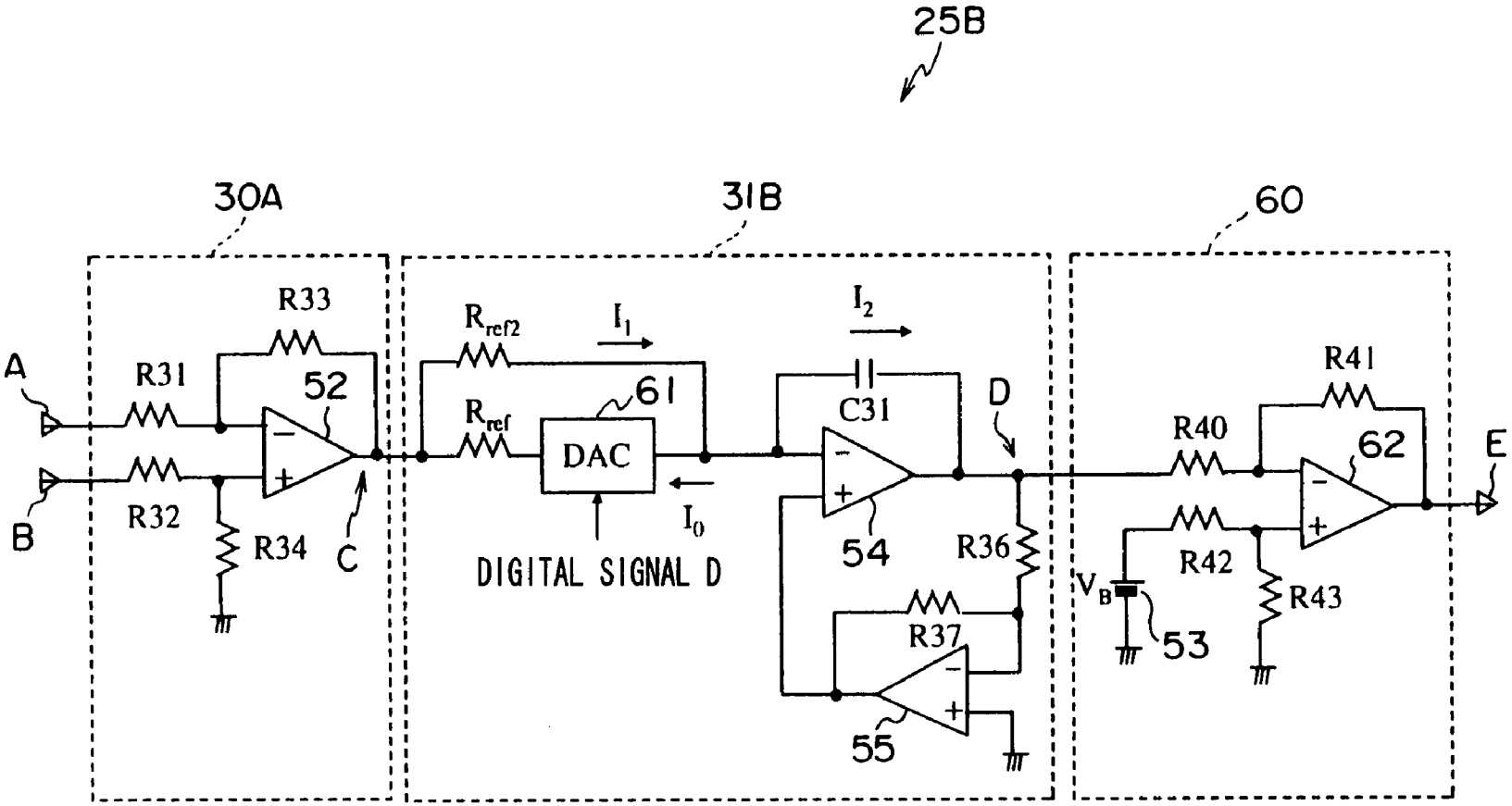
FIG. 11 is a circuit diagram of a triangular wave generation circuit relating to a variant example of the second exemplary embodiment.

As another mode, the triangular wave generation circuit may be structured as shown in FIG. 11.

A triangular wave generation circuit 25B shown in FIG. 11 is structured with a differential amplifier 30A, an integrated circuit 31B and a level-shift circuit 60.

The differential amplifier 30A differs from the differential amplifier 30 shown in FIG. 6 in that the other end of the resistor R34 is directly connected to ground, but is otherwise the same.

The integrated circuit 31 B differs from the integrated circuit 31 shown in FIG. 6 in being provided with a DAC (digital-analog converter) 61 and resistors $R_{ref}$ and $R_{ref2}$, and in that the non-inverting input terminal of the operational amplifier 55 is directly connected to ground, but is otherwise the same. Here, the resistance value of resistor $R_{ref2}$ is twice the resistance value of resistor $R_{ref}$.

As shown in FIG. 11, the level-shift circuit 60 is structured with resistors R40, R41, R42 and R43, an operational amplifier 62, and the DC power supply 53, which outputs the DC voltage $V_B$. One end of resistor R40 is connected to the output terminal of the operational amplifier 54, and the other end is connected to the inverting input terminal of the operational amplifier 62. One end of resistor R41 is connected to the inverting input terminal of the operational amplifier 62, and the other end is connected to the output terminal of the operational amplifier 62. One end of resistor R42 is connected to the non-inverting input terminal of the operational amplifier 62, and the other end is connected to the positive side of the DC power supply 53. One end of resistor R43 is connected to the non-inverting input terminal of the operational amplifier 62, and the other end is connected to ground.

The DAC 61 features a function of amplifying an output current $I_0$ by a digital signal D with N bits (N being a natural number), which is the frequency selection signal output from the control section 40. The output current $I_0$ is represented by the following equation with the resistance value $R_{ref}$ of the resistor $R_{ref}$ and the output voltage of the differential amplifier 30A, that is, the voltage $V_3$ at position C in FIG. 11.

$$I_0 = \frac{V_3}{R_{ref}} \times \frac{D}{2^N} \tag{7}$$

Therein, $0 \leqq D < 2^n - 1$, and the output current 10 here is a current which flows only in a sink direction of the DAC 61.

Hence, a current 12 which flows in capacitor C31 for feedback at the operational amplifier 54 is represented by the following equation, with a current that flows through resistor $R_{ref2}$ being $I_1$.

$$\begin{aligned} I_2 &= I_1 - I_0 \\ &= \frac{V_3}{2R_{ref}} - \frac{V_3}{R_{ref}}\frac{D}{2^N} \\ &= \frac{V_3}{R_{ref}}\left(\frac{1}{2} - \frac{D}{2^N}\right) \end{aligned} \tag{8}$$

Therefore, an integration period can be altered in accordance with the value of digital signal D. This is equivalent to altering the resistance value of the resistor R35 shown in FIG. 6.

Figures 12A, 12B, 12C, 12D, 12E:
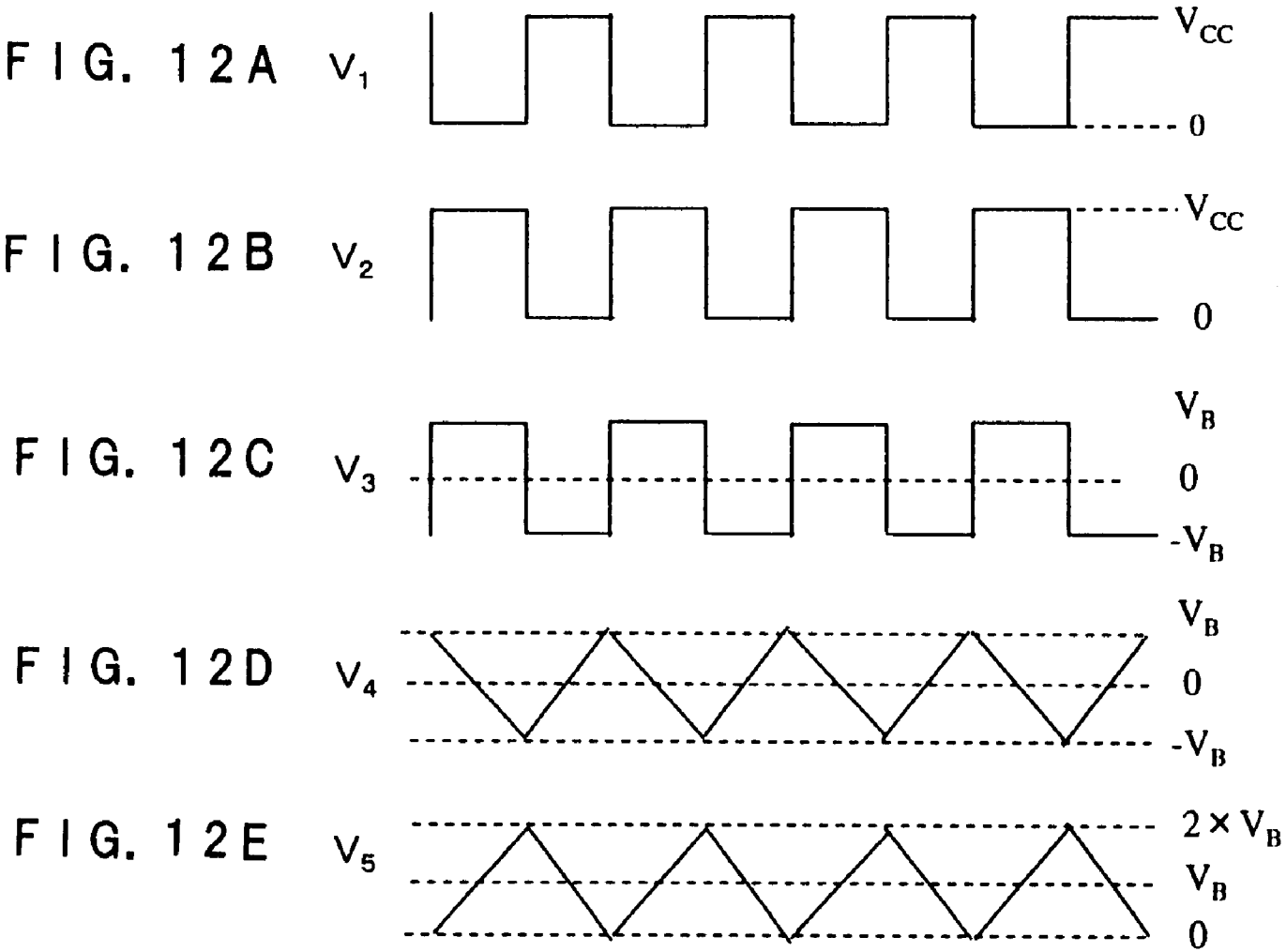
FIGS. 12A, 12B, 12C, 12D and 12E are waveform diagrams of voltages at locations of the triangular wave generation circuit.
Figure 13:
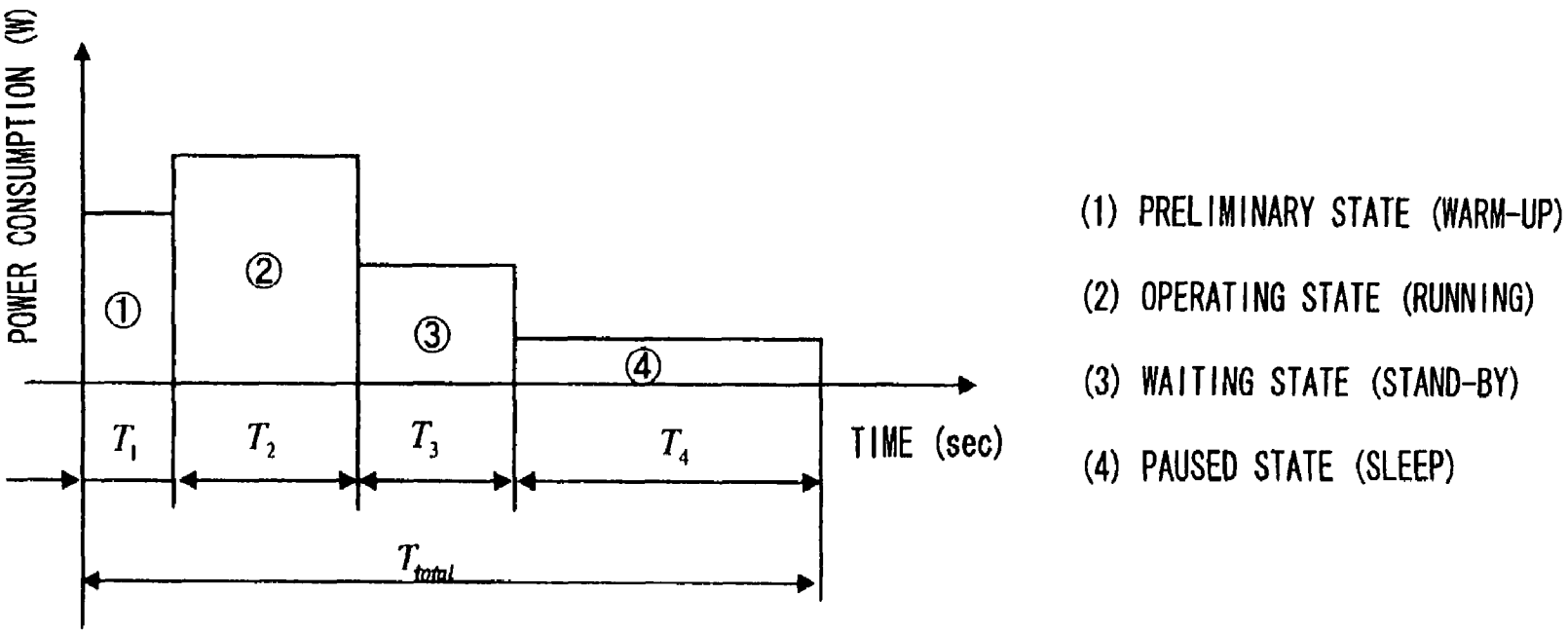

FIGS. 12A to 12E show examples of voltages $V_1$ to $V_5$ at positions A to E of FIG. 11. If the voltages $V_1$, $V_2$ and $V_3$ at positions A, B and C have waveforms as shown in FIGS. 12A, 12B and 12C, the output voltage $V_4$ of the integrated circuit 31B, that is, the voltage $V_4$ at position D of FIG. 11, is as shown in FIG. 12C, with $-V_B < V_4 < V_B$. Therefore, the voltage $V_B$ component is shifted in the positive direction by the level-shift circuit 60. As a result, a waveform of the output voltage of the level-shift circuit 60, that is, the voltage at position E shown in FIG. 11, is a waveform as shown in FIG. 12E.

A value of digital signal D is set to a value with which operations are proper in the running state, that is, the printing mode. On the other hand, for the non-printing mode, which is the standby state, the sleep state or the like, the value of digital signal D is such that operations are proper, with the value being set such that the amplitude $V_5$ of the triangular wave does not change when the switching frequency is lowered relative to the printing mode. That is, this value of digital signal D is larger than the value in the printing mode. When switching between the printing mode and the non-printing mode, the control section 40 switches the value of digital signal D. Thus, it is possible to generate a triangular wave whose switching frequency is variable with amplitude being constant.

If this triangular wave generation circuit 25B is combined with the frequency alteration section 24 shown in FIG. 6, the control section 40 may, at a time of mode-switching, switch the value of the digital signal D in synchronization with the switching of the frequency-division ratio n which is output through the port 42 to the counter 28.

Note that the present invention is not limited to the embodiments described above and is obviously applicable to embodiments with design modifications within the scope described in the attached claims.

What is claimed is:

1. A driving circuit of a droplet ejection head which, by supplying an analog driving signal to a driving element, ejects a droplet from a nozzle provided in correspondence with the driving element, the droplet ejection head driving circuit comprising:

a driving signal generation unit that generates at least a first analog driving signal for ejecting a droplet from the nozzle, and at least a second analog driving signal for vibrating a liquid surface of ink in the droplet ejection head, and selectively outputs either of the analog driving signals;

a pulse modulation unit that pulse-modulates the analog driving signal output from the driving signal generation unit and outputs a digital signal;

a switching signal generation unit that generates a switching signal;

an amplification unit that amplifies the digital signal by switching in accordance with the switching signal, and supplies the amplified digital signal to the driving element; and a frequency-setting unit that sets a switching frequency of the switching signal in accordance with a frequency selection signal, the frequency selection signal corresponding to the analog driving signal that is being output from the driving signal generation unit.

2. The droplet ejection head driving circuit of claim 1, further comprising an operational amplifier that outputs an error signal between a feedback signal, which feeds back the analog driving signal that is applied to the droplet ejection head, and the analog driving signal that is output from the driving signal generation unit, wherein the pulse modulation unit is a pulse width modulation unit, and the pulse width modulation unit is a comparator which outputs a result of comparison of the error signal with the switching signal as the digital signal.

3. The droplet ejection head driving circuit of claim 2, further comprising a filter that smoothes the output of the amplification unit and supplies the driving signal to the driving element.

4. The droplet ejection head driving circuit of claim 2, wherein a frequency of the second analog driving signal is lower than a frequency of the first analog driving signal, and when the first analog driving signal is being output from the driving signal generation unit, the frequency-setting unit sets a pre-specified first switching frequency which corresponds to the first analog driving signal, and when the second analog driving signal is being output from the driving signal generation unit, the frequency-setting unit sets a pre-specified second switching frequency which corresponds to the second analog driving signal and which is lower than the first switching frequency.

5. The droplet ejection head driving circuit of claim 2, wherein the frequency-setting unit comprises:

a square waveform oscillation unit that outputs a square waveform with a predetermined frequency; and a frequency-division unit that frequency-divides the square waveform in accordance with an inputted frequency-division ratio serving as the frequency setting signal, and wherein the switching signal generation unit generates the switching signal from the square waveform which has been frequency-divided by the frequency-division unit.

6. The droplet ejection head driving circuit of claim 2, wherein the frequency-setting unit comprises:

a plurality of square waveform oscillation units that output square waveforms with different frequencies for different oscillation units; and a square waveform selection unit that selects a square waveform, of the square waveforms output from the plurality of square waveform oscillation units, in accordance with the frequency selection signal, and wherein the switching signal generation unit generates the switching signal from the square waveform which has been selected by the square waveform selection unit.

7. The droplet ejection head driving circuit of claim 1, further comprising a filter that smoothes the output of the amplification unit and supplies the driving signal to the driving element.

8. The droplet ejection head driving circuit of claim 7, wherein a frequency of the second analog driving signal is lower than a frequency of the first analog driving signal, and when the first analog driving signal is being output from the driving signal generation unit, the frequency-setting unit sets a pre-specified first switching frequency which corresponds to the first analog driving signal, and when the second analog driving signal is being output from the driving signal generation unit, the frequency-setting unit sets a pre-specified second switching frequency which corresponds to the second analog driving signal and which is lower than the first switching frequency.

9. The droplet ejection head driving circuit of claim 7, wherein the frequency-setting unit comprises:

a square waveform oscillation unit that outputs a square waveform with a predetermined frequency; and a frequency-division unit that frequency-divides the square waveform in accordance with an inputted frequency-division ratio serving as the frequency setting signal, and wherein the switching signal generation unit generates the switching signal from the square waveform which has been frequency-divided by the frequency-division unit.

10. The droplet ejection head driving circuit of claim 7, wherein the frequency-setting unit comprises:

a plurality of square waveform oscillation units that output square waveforms with different frequencies for different oscillation units; and a square waveform selection unit that selects a square waveform, of the square waveforms output from the plurality of square waveform oscillation units, in accordance with the frequency selection signal, and wherein the switching signal generation unit generates the switching signal from the square waveform which has been selected by the square waveform selection unit.

11. The droplet ejection head driving circuit of claim 1, wherein a frequency of the second analog driving signal is lower than a frequency of the first analog driving signal, and when the first analog driving signal is being output from the driving signal generation unit, the frequency-setting unit sets a pre-specified first switching frequency which corresponds to the first analog driving signal, and when the second analog driving signal is being output from the driving signal generation unit, the frequency-setting unit sets a pre-specified second switching frequency which corresponds to the second analog driving signal and which is lower than the first switching frequency.

12. The droplet ejection head driving circuit of claim 11, wherein the frequency-setting unit comprises:

a square waveform oscillation unit that outputs a square waveform with a predetermined frequency; and a frequency-division unit that frequency-divides the square waveform in accordance with an inputted frequency-division ratio serving as the frequency setting signal, and wherein the switching signal generation unit generates the switching signal from the square waveform which has been frequency-divided by the frequency-division unit.

13. The droplet ejection head driving circuit of claim 11, wherein the frequency-setting unit comprises:

a plurality of square waveform oscillation units that output square waveforms with different frequencies for different oscillation units; and a square waveform selection unit that selects a square waveform, of the square waveforms output from the plurality of square waveform oscillation units, in accordance with the frequency selection signal, and wherein the switching signal generation unit generates the switching signal from the square waveform which has been selected by the square waveform selection unit.

14. The droplet ejection head driving circuit of claim 1, wherein the frequency-setting unit comprises:

a square waveform oscillation unit that outputs a square waveform with a predetermined frequency; and a frequency-division unit that frequency-divides the square waveform in accordance with an inputted frequency-division ratio serving as the frequency setting signal, and wherein the switching signal generation unit generates the switching signal from the square waveform which has been frequency-divided by the frequency-division unit.

15. The droplet ejection head driving circuit of claim 14, wherein the switching signal generation unit comprises a triangular wave generation unit, which generates a triangular wave from the square waveform which is output from the frequency-setting unit.

16. The droplet ejection head driving circuit of claim 15, wherein the triangular wave generation unit comprises an integrated circuit, and the integrated circuit includes:

an operational amplifier;

a plurality of capacitors with different capacitances for different capacitors that are connected in parallel between an inverting input terminal of the operational amplifier and an output terminal of the operational amplifier, the square waveform output from the frequency-setting unit being inputted to the inverting input terminal; and a capacitor selection unit that selects a capacitor, of the plurality of capacitors, in accordance with the frequency selection signal.

17. The droplet ejection head driving circuit of claim 15, wherein the triangular wave generation unit comprises an integrated circuit, and the integrated circuit includes:

an operational amplifier;

a capacitor that is connected between an inverting input terminal of the operational amplifier and an output terminal of the operational amplifier, the square waveform output from the frequency setting unit being inputted to the inverting input terminal; and a current control unit that controls a current value of the square waveform that is inputted to the inverting input terminal of the operational amplifier in accordance with the frequency selection signal.

18. The droplet ejection head driving circuit of claim 1, wherein the frequency-setting unit comprises:

a plurality of square waveform oscillation units that output square waveforms with different frequencies for different oscillation units; and a square waveform selection unit that selects a square waveform, of the square waveforms output from the plurality of square waveform oscillation units, in accordance with the frequency selection signal, and wherein the switching signal generation unit generates the switching signal from the square waveform which has been selected by the square waveform selection unit.

19. The droplet ejection head driving circuit of claim 18, wherein the switching signal generation unit comprises a triangular wave generation unit, which generates a triangular wave from the square waveform which is output from the frequency-setting unit.

20. A driving method of a droplet ejection head which, by supplying an analog driving signal to a driving element, ejects a droplet from a nozzle provided in correspondence with the driving element, the droplet ejection head driving method comprising:

generating at least a first analog driving signal, for ejecting a droplet from the nozzle, and a second analog driving signal, for vibrating a liquid surface of ink in the droplet ejection head, and selectively outputting either of the analog driving signals;

pulse-modulating the analog driving signal that is output and outputting a digital signal;

generating a switching signal;

amplifying the digital signal by switching in accordance with the switching signal, and supplying the amplified digital signal to the driving element; and setting a switching frequency of the switching signal in accordance with a frequency selection signal, the switching frequency signal corresponding to the analog driving signal that is being output.

21. A droplet ejection device comprising:

a droplet ejection head that, by supplying an analog driving signal to a driving element, ejects a droplet from a nozzle provided in correspondence with the driving element;

a driving signal generation unit that generates at least a first analog driving signal for ejecting a droplet from the nozzle, and at least a second analog driving signal for vibrating a liquid surface of ink in the droplet ejection head, and selectively outputs either of the analog driving signals;

a pulse modulation unit that pulse-modulates the analog driving signal output from the driving signal generation unit and outputs a digital signal;

a switching signal generation unit that generates a switching signal;

an amplification unit that amplifies the digital signal by switching in accordance with the switching signal, and supplies the amplified digital signal to the driving element;

an output unit that instructs the driving signal generation unit so as to output the first analog driving signal when an operational mode of the droplet ejection device is a printing mode, and instructs the driving signal generation unit so as to output the second analog driving signal when the operational mode is a non-printing mode, and the output unit outputs a frequency selection signal in accordance with the operational mode; and a frequency-setting unit that sets a switching frequency of the switching signal in accordance with the frequency selection signal that is being output from the output unit.

* * * * *